US008568945B2

(12) United States Patent
Tada et al.

(10) Patent No.: US 8,568,945 B2
(45) Date of Patent: Oct. 29, 2013

(54) ELECTROPHOTOGRAPHIC PHOTORECEPTOR, AND IMAGE FORMING APPARATUS AND PROCESS CARTRIDGE THEREFOR USING THE PHOTORECEPTOR

(75) Inventors: Hiromi Tada, Shizuoka-ken (JP); Naohiro Toda, Kanagawa-ken (JP); Yuuji Tanaka, Shizuoka-ken (JP); Norio Nagayama, Shizuoka-ken (JP); Yoshinori Inaba, Kanagawa-ken (JP); Takafumi Iwamoto, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 329 days.

(21) Appl. No.: 12/625,746

(22) Filed: Nov. 25, 2009

(65) Prior Publication Data

US 2010/0129112 A1 May 27, 2010

(30) Foreign Application Priority Data

Nov. 26, 2008 (JP) ..... 2008-300835
Oct. 22, 2009 (JP) ..... 2009-243393

(51) Int. Cl.
*G03G 5/047* (2006.01)
*G03G 15/04* (2006.01)

(52) U.S. Cl.
USPC ..... 430/59.5; 430/59.1; 399/111; 399/115

(58) Field of Classification Search
USPC ..... 430/59.5, 59.4, 59.1; 399/111, 115
See application file for complete search history.

(56) References Cited

U.S. PATENT DOCUMENTS 3,357,989 A 12/1967 Byrne et al.
6,010,810 A * 1/2000 Uesaka et al. ..... 430/58.8

(Continued)

FOREIGN PATENT DOCUMENTS

JP 58-182639 10/1983
JP 61-109056 5/1986

(Continued)

*Primary Examiner* — Jonathan Jelsma
(74) *Attorney, Agent, or Firm* — Cooper & Dunham LLP

(57) ABSTRACT

An electrophotographic photoreceptor, including a charge generation layer and a charge transport layer on an electroconductive substrate, wherein the charge generation layer includes titanylphthalocyanine and a binder resin which is a crosslinked material of a resin comprising a polyvinylbutyrat site having the following formula (1) and an isocyanate compound having the following formula (2):

(1)

wherein R1 and R2 independently represent an alkyl group having 1 to 3 carbon atoms; k, l, m and n represent composition ratios and k+1 is from 0.60 to 0.80, wherein k or 1 may be 0, m is from 0.02 to 0.03, and n is from 0.20 to 0.40;

(2)

wherein A represents a substituted or unsubstituted organic group having 2 to 4 valences; and O represents an integer of from 2 to 4.

6 Claims, 4 Drawing Sheets

(56) References Cited

U.S. PATENT DOCUMENTS

| | | | | |
|---|---|---|---|---|
| 7,354,686 | B2 * | 4/2008 | Toda et al. | 430/58.7 |
| 2007/0117033 | A1 * | 5/2007 | Sugino et al. | 430/58.7 |

FOREIGN PATENT DOCUMENTS

| | | |
|---|---|---|
| JP | 61-239248 | 10/1986 |
| JP | 62-67094 | 3/1987 |
| JP | 63-364 | 1/1988 |
| JP | 63-366 | 1/1988 |
| JP | 64-17066 | 1/1989 |
| JP | 1-123868 | 5/1989 |
| JP | 3-56470 | 8/1991 |
| JP | 3-225346 | 10/1991 |
| JP | 5-31137 | 5/1993 |
| JP | 5-55860 | 8/1993 |
| JP | 5-263007 | 10/1993 |
| JP | 5-279591 | 10/1993 |
| JP | 6-1386 | 1/1994 |
| JP | 6-83078 | 3/1994 |
| JP | 6-29975 | 4/1994 |
| JP | 7-72634 | 3/1995 |
| JP | 7-72637 | 3/1995 |
| JP | 7-72638 | 3/1995 |
| JP | 7-97221 | 10/1995 |
| JP | 8-160643 | 6/1996 |
| JP | 9-120167 | 5/1997 |
| JP | 11-140337 | 5/1999 |
| JP | 3016296 | 12/1999 |
| JP | 2000-98641 | 4/2000 |
| JP | 2001-117248 | 4/2001 |
| JP | 2003-29429 | 1/2003 |
| JP | 3503304 | 12/2003 |
| JP | 3535617 | 3/2004 |
| JP | 3567597 | 6/2004 |
| JP | 2005-15682 | 1/2005 |
| JP | 2005-202281 | 7/2005 |
| JP | 2006-133701 | 5/2006 |
| JP | 2006-154049 | 6/2006 |
| JP | 2007-212670 | 8/2007 |
| JP | 2007-219257 | 8/2007 |
| JP | 4148567 | 7/2008 |
| WO | WO 03/027184 A2 | 4/2003 |

* cited by examiner

ELECTROPHOTOGRAPHIC PHOTORECEPTOR, AND IMAGE FORMING APPARATUS AND PROCESS CARTRIDGE THEREFOR USING THE PHOTORECEPTOR

BACKGROUND OF THE INVENTION

1. Field of the Invention

The present invention relates to an electrophotographic photoreceptor, and more particularly to an electrophotographic photoreceptor producing less defective images such as background fouling, and having good environmental stability and uniform potential, and to an image forming apparatus using the electrophotographic photoreceptor.

2. Discussion of the Related Art

Recently, information processing systems using electrophotography are noticeably developed. In particular, laser printers and digital copiers converting information into digital signals with light have been dramatically improved in print qualities and reliability. The laser printers and digital copiers rapidly prevailing are being required to produce full-color images and images having higher quality.

Electrophotographic photoreceptors using organic photosensitive materials are widely used because of their cost, productivity, environmental stability, etc. The electrophotographic photoreceptors are broadly classified into functionally-separated multilayer photoreceptors including a charge generation layer having charge generatability and a charge transport layer having charge transportability, and single-layered photoreceptors having charge generatability and charge transportability in a layer. The multilayer photoreceptors are mostly used because materials thereof can be selected from a wide range, and sensitivity, stability and mechanical strength thereof have improved.

The charge generation materials for use in the charge generation layer of the multilayer organic photoreceptors include various materials such as azo pigments and phthalocyanine pigments. Particularly, phthalocyanine pigments having high sensitivity for light having a long wavelength of from 500 to 800 nm are most effectively used as a material for photoreceptors of electrophotographic printers and digital copiers using a LED and a LD as a light source.

Phthalocyanine includes a titanyl phthalocyanine pigment, a metal-free phthalocyanine pigment, a hydroxy gallium phthalocyanine pigment, etc. Specific examples of the titanyl phthalocyanine pigment include an α-type disclosed in Japanese published unexamined publication No. 61-239248, a Y-type disclosed in Japanese published unexamined publication No. 64-17066, an I-type disclosed in Japanese published unexamined publication No. 61-109056, an A-type disclosed in Japanese published unexamined publication No. 62-67094, a B-type disclosed in Japanese published unexamined publications Nos. 63-364 and 63-366, a B-type disclosed in Japanese published unexamined publication No. 2005-15682, a m-type disclosed in Japanese published unexamined publication No. 63-198067, a semi-amorphous type disclosed in Japanese published unexamined publication No. 1-123868, etc. Specific example of the metal-free phthalocyanine pigment include a X-type metal-free phthalocyanine disclosed in U.S. Pat. No. 3,357,989, a τ-type metal-free phthalocyanine disclosed in Japanese published unexamined publication No. 58-182639, etc. Specific examples of the hydroxy gallium pigment are disclosed in Japanese published unexamined publications Nos. 5-263007 and 5-279591.

The charge generation layer (CGL) is typically formed by coating a CGL coating liquid in which a charge generation material (CGM) is dispersed in a binder resin, and therefore it is essential that the coating liquid has dispersion stability to form a uniform CGL and the binder resin is known to affect the dispersion stability.

Japanese published unexamined publications Nos. 11-140337, 2007-219257, 2007-212670, 2006-133701, etc. disclose using a polyvinylacetal resin to stabilize the dispersion of a titanylphthalocyanine pigment. Japanese published unexamined publication No. 09-120167, etc. disclose using a polycarbonate resin. Japanese patent No. 3,016,296 discloses using a mixture of a vinylchloride-vinylacetate copolymer and a polyvinylacetal resin.

Photoreceptors using titanylphthalocyanine often have environmental stability problems because titanylphthalocyanine varies in sensitivity with humidity.

Japanese published unexamined publications Nos. 07-072638, 07-072637, 2006-154049, etc. disclose hydrophobizing a resin in a CGL to decrease the sensitivity variation due to humidity change.

The multilayer photoreceptor is formed by dipping a drum in a coating liquid to sequentially form a CGL, a charge transport layer (CTL), etc. on the drum. When an underlayer of the CTL is soluble with a CTL coating liquid, since the upper end and the bottom end of the drum are dipped in the CTL coating liquid for different times when coated therewith, the CGL is unevenly dissolved and the upper end and the bottom end of the drum have different sensitivity, and a charge transport material (CTM) penetrates the underlayer, resulting in background fouling.

Japanese published unexamined publication No. 08-160643 disclose cross-linking a polyvinylacetal resin and a melamine resin to form an underlayer of a CTL such that the underlayer is not dissolved by a CTL coating liquid.

Further, Japanese published unexamined application No. 6-83078 discloses, when a polar group derived from a monomer including a hydroxy group such as 2-hydorxyethylacrylate is introduced into a vinylchloride-acrylic polymer binder to reduce aggregation of a CGM for improving storage stability of a CGL coating liquid, an isocyanate compound may be reacted with the vinylchloride-acrylic polymer to break the hydroxy group deteriorating solvent resistance and humidity resistance of a photoreceptor. However, specific examples thereof are not disclosed and an azo pigment is used as a CGM, and does not aim at maintaining sensitivity and chargeability of a photoreceptor using titanylphthalocyanine. Japanese published unexamined application No. 7-72634 discloses in its Examples 8 and 16 a CGL including ω, ω'-bis(p-N,N-dialkylaminoaryl)-polyethylene oxide and formed with a coating liquid including polyvinylbutyral and tolyelen-2,2-diisocyanate as a binder for a photoreceptor having less irradiation fatigue and high sensitivity. However, this uses an azo pigment as a CGM as well, and does not aim at maintaining sensitivity and chargeability of a photoreceptor using titanylphthalocyanine, either.

Because of these reasons, a need exists for an electrophotographic photoreceptor preventing background fouling, having good environmental stability, uniform potential characteristic, and sufficient and stable high sensitivity.

SUMMARY OF THE INVENTION

Accordingly, an object of the present invention is to provide an electrophotographic photoreceptor inhibiting injection of a charge from its substrate to prevent background fouling, having good environmental stability, i.e., its properties do not change with humidity, uniform inner potential properties, and fully exerting high sensitivity titanylphthalocyanine has.

Another object of the present invention is to provide a CGL coating liquid having good dispersion stability and a CTL coating liquid having stable quality such that the CGL is not dissolved out when the CTL coating liquid is coated thereon.

To achieve such objects, the present invention contemplates the provision of an electrophotographic photoreceptor, comprising a charge generation layer and a charge transport layer on an electroconductive substrate, wherein the charge generation layer comprises titanylphthalocyanine and a binder resin which is a crosslinked material of a resin comprising a polyvinylbutyral site having the following formula (1) and an isocyanate compound having the following formula (2):

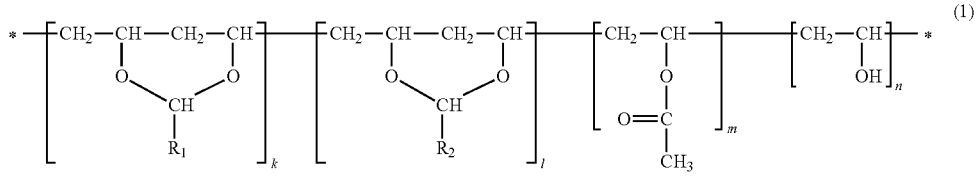

(1)

wherein R1 and R2 independently represent an alkyl group having 1 to 3 carbon atoms; k, l, m and n represent composition ratios and k+l is from 0.60 to 0.80, wherein k or l may be 0, m is from 0.02 to 0.03, and n is from 0.20 to 0.40;

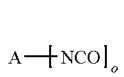

(2)

wherein A represents a substituted or unsubstituted organic group having 2 to 4 valences; and O represents an integer of from 2 to 4.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
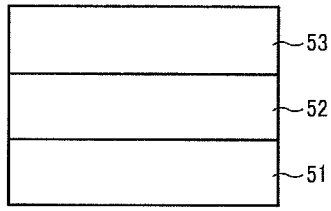
FIG. 1 is a schematic view illustrating a layer structure of the electrophotographic photoreceptor for use in the present invention.

Generally, the present invention provides an electrophotographic photoreceptor inhibiting injection of a charge from its substrate to prevent background fouling, having good environmental stability, i.e., its properties do not change with humidity, uniform inner potential properties, and fully exerting high sensitivity titanylphthalocyanine has. Particularly, the present invention relates to an electrophotographic photoreceptor, comprising a charge generation layer and a charge transport layer on an electroconductive substrate, wherein the charge generation layer comprises titanylphthalocyanine and a binder resin which is a crosslinked material of a resin comprising a polyvinylbutyral site having the following formula (1) and an isocyanate compound having the following formula (2):

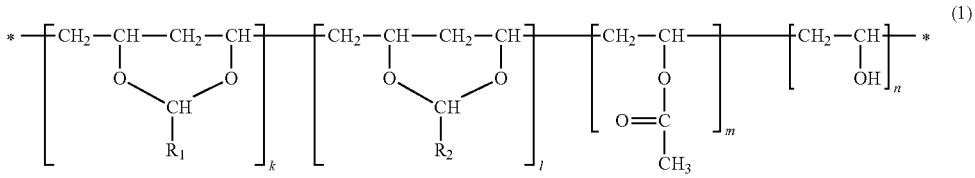

(1)

wherein R1 and R2 independently represent an alkyl group having 1 to 3 carbon atoms; k, l, m and n represent composition ratios and k+l is from 0.60 to 0.80, wherein k or l may be 0, m is from 0.02 to 0.03, and n is from 0.20 to 0.40;

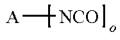

(2)

wherein A represents a substituted or unsubstituted organic group having 2 to 4 valences; and O represents an integer of from 2 to 4.

In addition, the present invention provides a CGL coating liquid having good dispersion stability and a CTL coating liquid having stable quality such that the CGL is not dissolved out when the CTL coating liquid is coated thereon.

Some of the binder resin in the CGL affecting transport of a charge generated by the CGM to the CTL, an undercoat layer or the substrate exerts a harmful influence upon the photoreceptor properties.

The crosslinked material of a resin including at least polyvinylbutyral site having the formula (1), and a compound having an isocyanate group and the formula (2) is fully crosslinked and can exert high sensitivity of titanylphthalocyanine.

A polyvinylacetal resin including a polyvinylbutyral site not only has good affinity with a CGM but also has good adhesiveness to other surfaces such as those of substrates and UL layers. In addition, it endures contraction stress due to crosslinkage and does not lose the original connection with a CGM, and the resultant photoreceptor is thought to fully exert its electrostatic properties.

Namely, a CTL coating liquid excessively penetrates an uncrosslinked CGL and a CTM penetrates a substrate from the CGL, and a charge leaks from the substrate, resulting in background fouling. However, the crosslinked CGL of the present invention prevents penetration of the CTM.

Further, the CGL including many hydroxyl groups has higher sensitivity in an environment of high humidity than in an environment of low humidity because adsorbed water increases around the titanylphthalocyanine pigment in the environment of high humidity. In the present invention, a hydroxyl group in polyvinylacetal is crosslinked with an isocyanate compound to absorb sensitivity.

In addition, a crosslinked CGL prevents itself from dissolving out to a CTL and prevents different electrical properties in a longitudinal direction of the photoreceptor drum, which is caused by differences of penetration amount of a CTM into the CGL and dissolution amount of a resin in the CGL into a CTL coating liquid due to differences of dipping time into the CTL coating liquid in the longitudinal direction of the drum when coated therewith by a dip coating method.

When a CTM less penetrates a CGL, a CGM and the CTM have less contact area, and the sensitivity of the photoreceptor is supposed to deteriorate in general. However, the photoreceptor of the present invention can maintain high sensitivity.

The reason is not clarified, but a hydroxyl group of a butyral resin and isocyanate are crosslinked to form a urethane bond, which is thought to increase a polarity around the CGM and accelerate the charge separation. This is thought to be a specific effect of titanylphthalocyanine having very high sensitivity and a charge generating mechanism largely affected by an external electric field.

In addition, when a CTL layer is formed on a CGL, the CGL is partly dissolved out and the CGL component is more mixed in the CTL coating liquid to be denatured while the CTL coating liquid is coated on the CGL. However, the CGL is fully crosslinked to prevent itself from being dissolved out in the CTL coating liquid.

Further, an undercoat layer is formed such that a metal oxide is dispersed in a hardening resin. Particularly in a negatively-charged photoreceptor which is currently prevailing, coating liquids of upper layers, i.e., a CGL and a CTL are dissolved out in the undercoat layer when coated and a CTM penetrates the undercoat layer through the CGL. The undercoat layer cannot sufficiently block a positive charge from injecting in the upper layers from a substrate, resulting in defective images such as background fouling. This can be prevented by the crosslinked CGL.

In order to maintain dispersion stability of a titanylphthalocyanine pigment, a binder resin in a coating liquid preferably has more hydroxyl groups because the pigment has a surface having a polarity. However, the CGL preferably has less hydroxyl groups to improve its environmental resistance.

In the present invention, a hydroxyl group is reacted after a CGL is formed to form a crosslinked structure and the hydroxyl group is decreased such that the pigment has dispersion stability and the CGL has environmental resistance.

Embodiments of layer structure of the photoreceptor of the present invention will be explained, referring to drawings.

Figure 2:
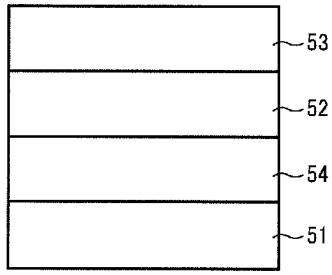
FIG. 2 is a schematic view illustrating another layer structure of the electrophotographic photoreceptor for use in the present invention.
Figure 3:
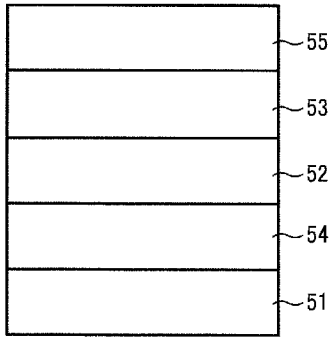
FIG. 3 is a schematic view illustrating a further layer structure of the electrophotographic photoreceptor for use in the present invention.

In FIG. 1, a CGL (52) and a CTL (53) are formed on an electroconductive substrate (51). As shown in FIG. 2, an undercoat layer (54) may be formed between an electroconductive substrate (51) and a CGL (52). As shown in FIG. 3, a protection layer (55) may be formed on a CTL (53).

Each structure will be explained.

<Electroconductive Substrate>

Suitable materials for the electroconductive substrate 31 include materials having a volume resistance not greater than $10^{10}$ Ω·cm. Specific examples of such materials include plastic cylinders, plastic films or paper sheets whose surface is deposited or sputtered with a metal such as aluminum, nickel, chromium, nichrome, copper, gold, silver, platinum, etc., or a metal oxide such as tin oxides, indium oxides, etc. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which are disclosed in Japanese published unexamined application No. 52-36016, can also be used as the substrate.

Besides, substrates on which a coating liquid including a binder resin and an electroconductive powder is coated can also be used as the substrate. Specific examples of such an electroconductive powder include carbon black, acetylene black, powders of metals such as aluminum, nickel, iron, Nichrome, copper, zinc, silver, etc., and metal oxides such as electroconductive tin oxides, ITO.

Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins, etc. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

Further, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate.

<CGL>

The CGL of the present invention includes a titanylphthalocyanine pigment as a CGM and a crosslinked material of a resin including at least a polyvinylbutyral site and a compound having an isocyanate group as a binder resin. The polyvinylbutyral site has the following formula (1):

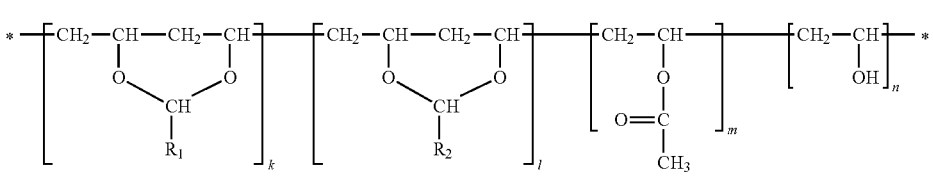

(1)

wherein R1 and R2 independently represent an alkyl group having 1 to 3 carbon atoms; k, l, m and n represent composition ratios and k+l is from 0.60 to 0.80, wherein k or l may be 0, m is from 0.02 to 0.03, and n is from 0.20 to 0.40.

A hydroxyl group of the polyvinylacetal resin affects dispersibility of the titanylphthalocyanine pigment. The hydroxyl group is an adsorption point of the titanylphthalocyanine pigment and is thought to contribute to dispersion stability of the coating liquid.

The hydroxyl group of the polyvinylacetal resin reacts with the compound having an isocyanate group to form a crosslinked structure.

n in the formula (1) is preferably from 0.20 to 0.40, and more preferably from 0.30 to 0.40.

When less than 0.2, a CGL is dissolved when coated with a CTL coating liquid and a CTM penetrates into the CGL, resulting in background fouling and sensitivity difference. When greater than 0.4, the polyvinylacetal deteriorates in synthetic efficiency.

Further, a molecular weight of the resin affects dispersibility of the titanylphthalocyanine pigment. The polyvinylacetal resin preferably has a molecular weight of from 40,000 to 130,000, and more preferably from 60,000 to 130,000. When too low, the liquid viscosity lowers and the dispersion stability deteriorates. When too high, the solubility deteriorates and a dispersion liquid is difficult to prepare.

Two or more polyvinylacetal resins having a different molecular weight or an acetalation degree may be used.

The compound having an isocyanate group for use in the present invention can be selected according to the purpose, and aliphatic multivalent isocyanates, alicyclic multivalent isocyanates, aromatic multivalent isocyanates, aromatic aliphatic multivalent isocyanates, etc. can be used. These can be used alone or in combination.

Specific examples of the isocyanate compounds include those having the following formula (2):

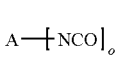

(2)

wherein A represents a substituted or unsubstituted organic group having 2 to 4 valences; and O represents an integer of from 2 to 4.

Among the isocyanate compounds having the formula (2), those having the following formulae (3) to (7) are preferably, and that having the formula (3) or (4) is more preferably used because of having good dispersion stability of the coating liquid:

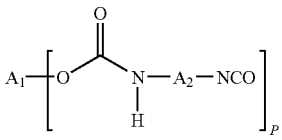

(3)

wherein $A_1$ represents an organic group having 2 to 4 valences; $A_2$ represents an organic group; and p represents an integer of from 2 to 4;

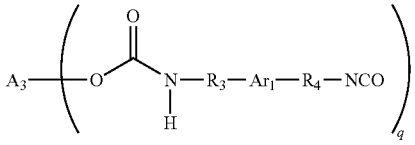

(4)

wherein $A_3$ represents a substituted or an unsubstituted non-aromatic hydrocarbon group or an aryl group; $Ar_1$ represents a substituted or an unsubstituted aromatic ring; $R_3$ and $R_4$ independently represent a divalent organic group having 1 to 3 carbon atoms or a single bond; and q represents an integer of from 2 to 4.

Specific examples the isocyanate compounds having the formula (4) include the following ones:

(4)-1

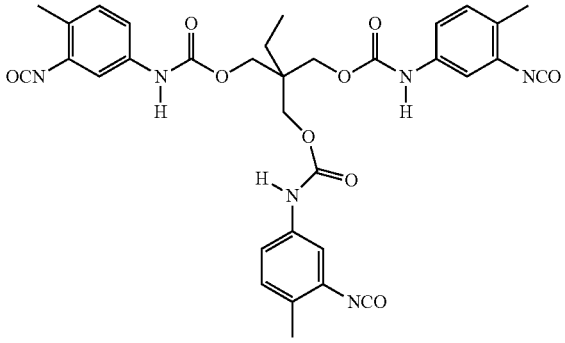

(4)-2

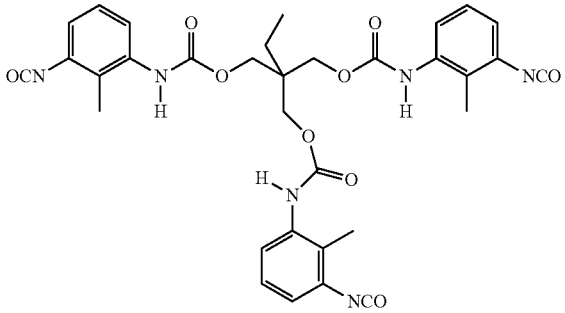

(4)-3

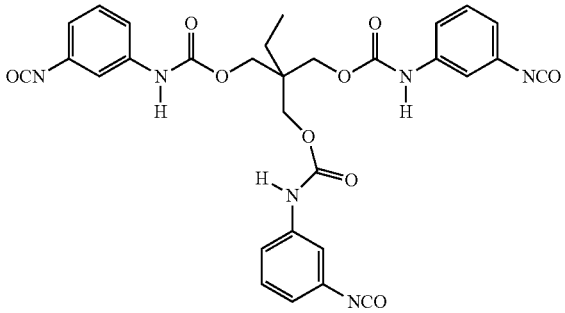

-continued
(4)-4
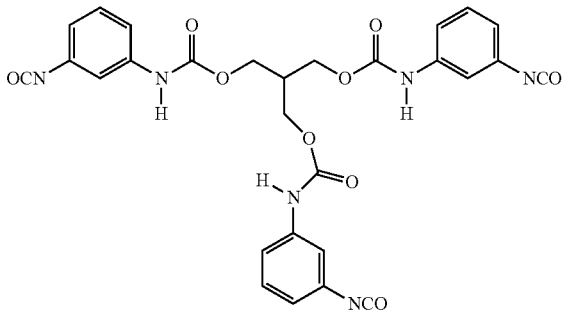
(4)-5
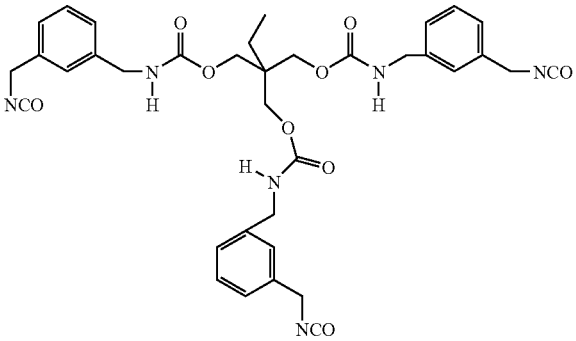
(4)-6
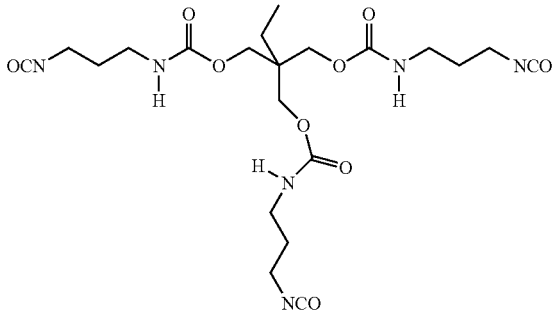
(4)-7
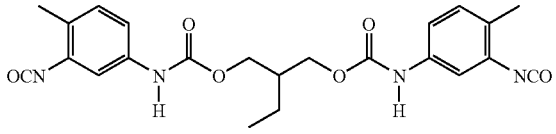
(4)-8
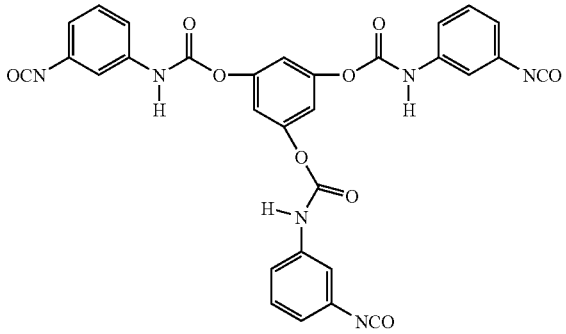
-continued
(4)-9
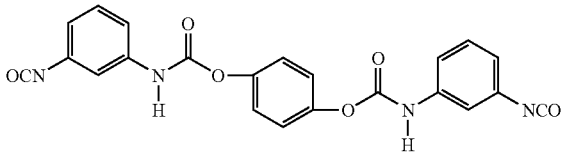
(5)
$$OCN—R_5—Ar_2—R_6—NCO$$
wherein $Ar_2$ represents a substituted or an unsubstituted aromatic ring; and $R_5$ and $R_6$ independently represent a divalent aromatic hydrocarbon group having 1 to 3 carbon atoms or a single bond.
Specific examples the isocyanate compounds having the formula (5) include the following ones:
(5)-1
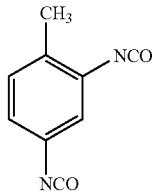
(5)-2
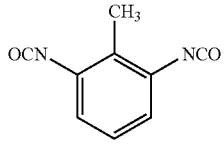
(5)-3
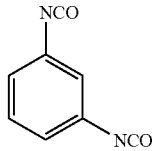
(5)-4
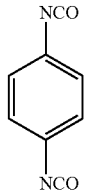
(5)-5
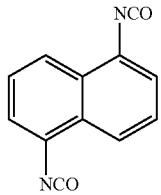
(5)-6
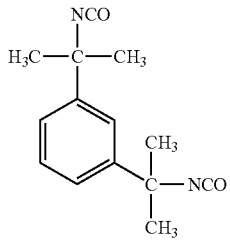

-continued
(5)-7
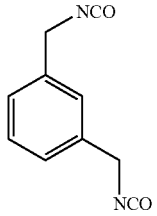
(5)-8
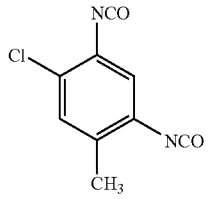
(5)-9
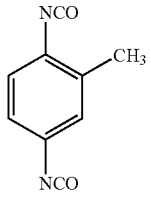
(5)-10
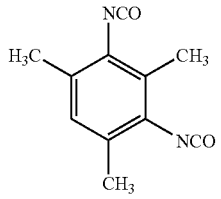
(5)-11
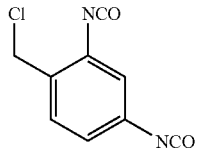
(6)
$$OCN—R_7—NCO$$
wherein $R_7$ represents a substituted or an unsubstituted hydrocarbon group.
Specific examples the isocyanate compounds having the formula (6) include the following ones:
(6)-1
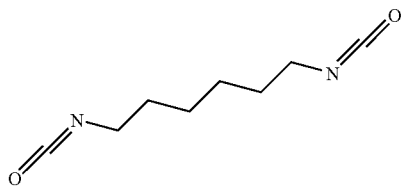
-continued
(6)-2
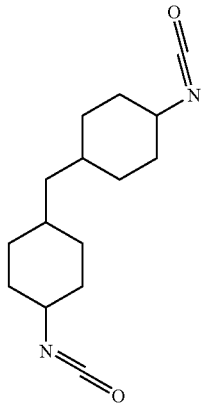
(6)-3
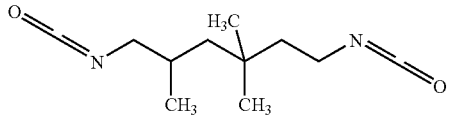
(6)-4
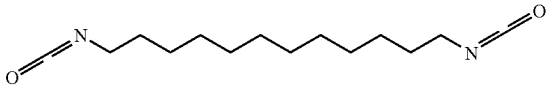
(6)-5
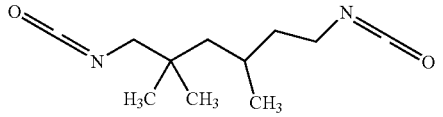
(6)-6
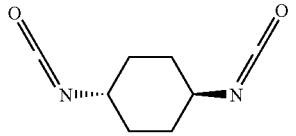
(6)-7
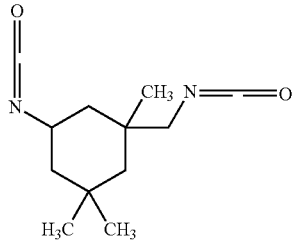
(6)-8
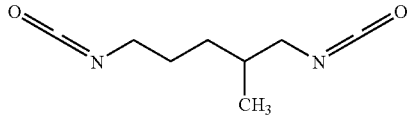
(6)-9
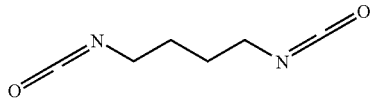
(6)-10
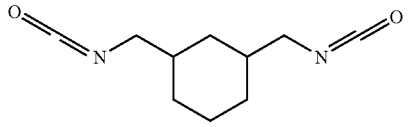

-continued
(6)-11
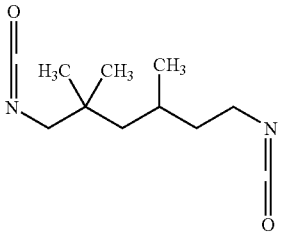
(6)-12
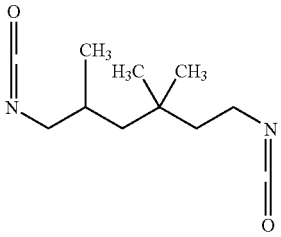
(6)-13
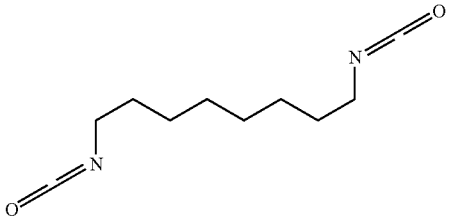
(6)-14
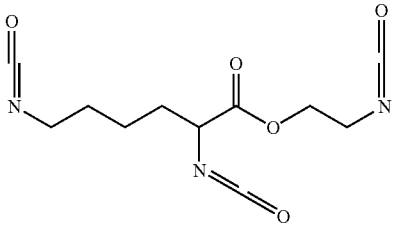
(6)-15
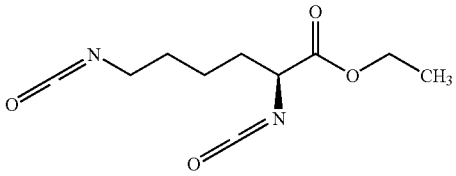
(6)-16
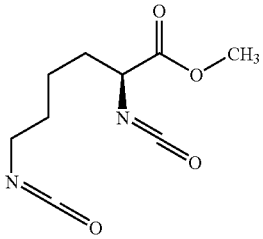
(7)
$$OCN—Ar_3—X_1—Ar_4—NCO$$
wherein $X_1$ represents a substituted or an unsubstituted divalent organic group, an ether bond or a single bond; and $Ar_3$ and $Ar_4$ independently represent a substituted or an unsubstituted aromatic ring.
Specific examples the isocyanate compounds having the formula (7) include the following ones:
(7)-1
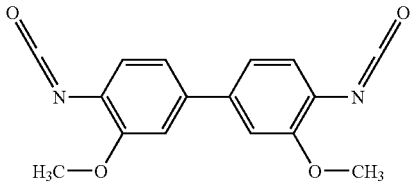
(7)-2
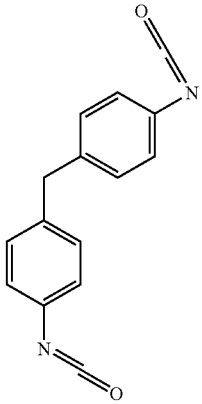
(7)-3
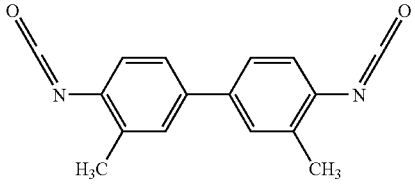
(7)-4
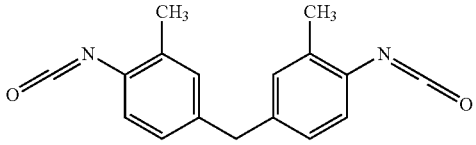
(7)-5
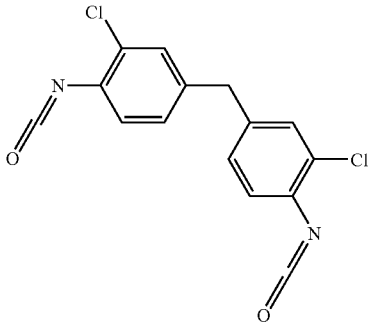
(7)-6
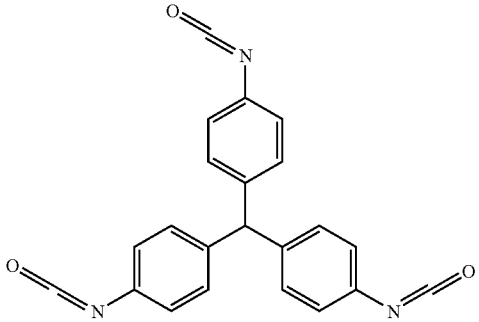

-continued (7)-7

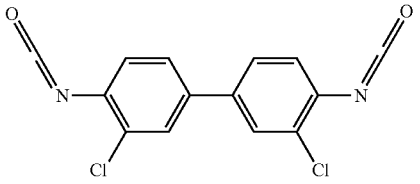

(7)-8

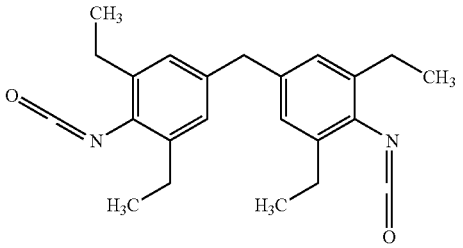

(7)-9

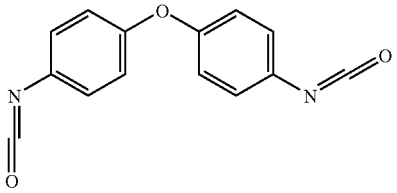

(7)-10

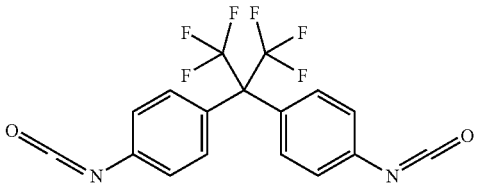

(7)-11

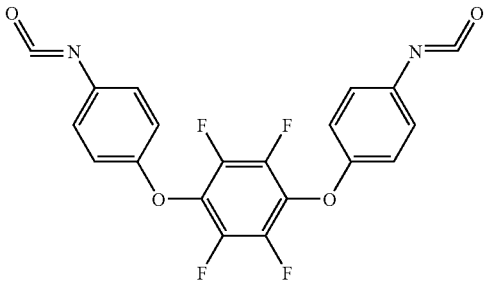

The compound having an isocyanate group is preferably included in the dispersion after a dispersion of the titanylphthalocyanine pigment and the polyvinylacetal resin is prepared in terms of the dispersion stability because of having good reactivity. The dispersion preferably includes the compound having an isocyanate group in an amount of from 0.25 to 3 parts by weight per 1 part by weight of the polyvinylacetal resin.

Next, the titanylphthalocyanine pigment effectively used in the present invention will be explained.

Titanylphthalocyanine pigment having any known crystal forms can be used, and particularly a titanylphthalocyanine pigment having a CuKα 1.542 Å X-ray diffraction spectrum comprising a maximum diffraction peak at a Bragg (2θ) angle of 27.2° is effectively used in the present invention.

The CGL preferably includes a CGM in an amount of from 0.5 to 5 parts by weight, and more preferably from 1.0 to 3 parts by weight per 1 part of the binder resin. When less than 0.5 parts by weight, the sensitivity deteriorates or a charge trap is likely to be formed. When greater than 5 parts by weight, he pigment is not fully dispersed or the CGL is not fully crosslinked.

The CGM preferably has a particle diameter of from 0.01 to 1.0 μm, and more preferably from 0.05 to 0.5 μm.

The CGL preferably has a thickness of from 1 to 5 times, and more preferably from 1 to 3 times of an average particle diameter of the CGM, although depending the particle diameter thereof.

The CGM may dispersed by any known dispersion methods, using a ball mill, an attritor, a sand mill or a supersonic disperser. Suitable solvents for use in the coating liquid for preparing the CGL include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc. In particular, ketone type solvents, ester type solvents and ether type solvents are preferably used. These can be used alone or in combination. The resin may be included before or after the pigment is dispersed, and preferably included before the pigment is dispersed in consideration of the crystal and dispersion stability.

In the present invention, an isocyanate compound is included in a dispersion in which a titanyl phthalocyanine pigment is dispersed in a binder resin solution to prepare a CGL coating liquid. Optionally, the CGL coating liquid may include additives such as a sensitizer, a dispersant, a surfactant and a silicone oil.

The coating liquid can be coated by known coating methods such as dip coating, spray coating, bead coating, nozzle coating, spinner coating and ring coating methods. The CGL preferably has a thickness of from 0.01 to 5 μm, and more preferably from 0.1 to 2 μm. The CGL is heated after coated to be crosslinked and dried. The CGL is preferably heated at from 115 to 150° C. to fully react the polyvinyl acetal resin and the isocyanate compound. When too high, constituent materials of the photoreceptor is adversely affected and the photoreceptor occasionally deteriorates in its properties, and therefore the CGL is heated at 135° C. or lower. The CGL is preferably heated for 10 min or longer, and more preferably 20 min or longer.

<CTL>

Next, the CTL will be explained.

The CTL can be formed by dissolving or dispersing a CTM and a binder resin in a proper solvent coating the coating liquid on the CGL and drying the coated liquid. Additives such as plasticizers, leveling agents, antioxidants and lubricants can optionally be included in the coating liquid alone or in combination.

Specific examples of the CTM include materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidinederivatives, diarylmethanederivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc. These CTMs can be used alone or in combination.

The CTL preferably includes the CTM in an amount of from 20 to 300 parts by weight, and more preferably from 40 to 150 parts by weight per 100 parts by weight of the binder resin. Specific examples of the binder resin include thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins and alkyd resins.

Suitable solvents for use in the coating liquid include tetrahydrofuran, dioxane, toluene, dichloromethane, monochlorobenzene, dichloroethane, cyclohexanone, methyl ethyl ketone, acetone, diethylether, etc. These can be used alone or in combination.

The CTL preferably has a thickness of from 10 to 50 μm, and more preferably from 15 to 35 μm in terms of image resolution and responsivity.

The coating liquid can be coated by known coating methods such as dip coating, spray coating, bead coating, nozzle coating, spinner coating and ring coating methods. The CTL needs to have a specific thickness and is preferably coated by the dip coating method in a liquid having high viscosity.

The CTL is heated and dried in an oven, etc. after coated. The drying temperature is preferably from 80 to 160, and more preferably from 110 to 140° C., although depending on the solvent included in the coating liquid. The CTL is preferably dried for 10 min or longer, and more preferably 20 min or longer.

<Undercoat Layer>

In the photoreceptor of the present invention, an undercoat layer may be formed between the electroconductive substrate and the CGL.

The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins and epoxy resins.

The undercoat layer may include a fine powder of metal oxides such as titanium oxide, silica, alumina, zirconium oxide, tin oxide and indium oxide to prevent occurrence of moiré in the resultant images and to decrease residual potential of the photoreceptor.

The undercoat layer can also be formed by coating a coating liquid using a proper solvent and a proper coating method similarly to those for use in formation of the CGL ad CTL mentioned above. The undercoat layer may be formed using a silane coupling agent, titanium coupling agent or a chromium coupling agent.

<Protection Layer>

In the present invention, the photoreceptor may have a protection layer on the outermost surface to improve abrasion resistance. Any known protection layers such as polymeric CTM layers, filler-dispersion layers and hardened layers can be used in the present invention.

<Image Forming Apparatus>

Next, the electrophotographic image forming method and image forming apparatus of the present invention will be explained, referring to the drawings.

Figure 4:
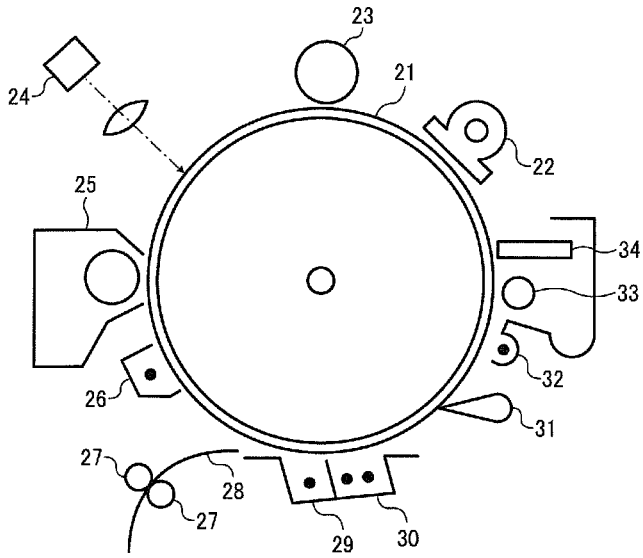
FIG. 4 is a schematic view for explaining the electrophotographic image forming process and apparatus of the present invention.

FIG. 4 is a schematic view illustrating an embodiment of image forming apparatus for explaining the electrophotographic image forming process of the present invention.

In FIG. 4, a photoreceptor (21) has the shape of a drum, and may have the shape of a sheet or an endless belt. Known chargers such as corotrons, scorotrons, solid state chargers, charging rollers and transfer rollers can be used for a charging roller (23), a pre-transfer charger (27), a transfer charger (30), a separation charger (31) and a pre-cleaning charger (33).

Non-contact chargers such as corona chargers and contact chargers with charging members such as a roller and a brush are typically used, and both of them effectively used in the present invention. Particularly, the charging roller is capable of reducing generation of ozone much more than corotron and scorotron, and effectively improves stability of a photoreceptor when repeatedly used and prevents images from deteriorating. However, the charging roller is contaminated due to repeated use because of contacting a photoreceptor, resulting in production abnormal images and deterioration of abrasion resistance. Particularly, a photoreceptor having high abrasion resistance is difficult to reface, and it is necessary to reduce the contamination of the charging roller.

Figure 5:
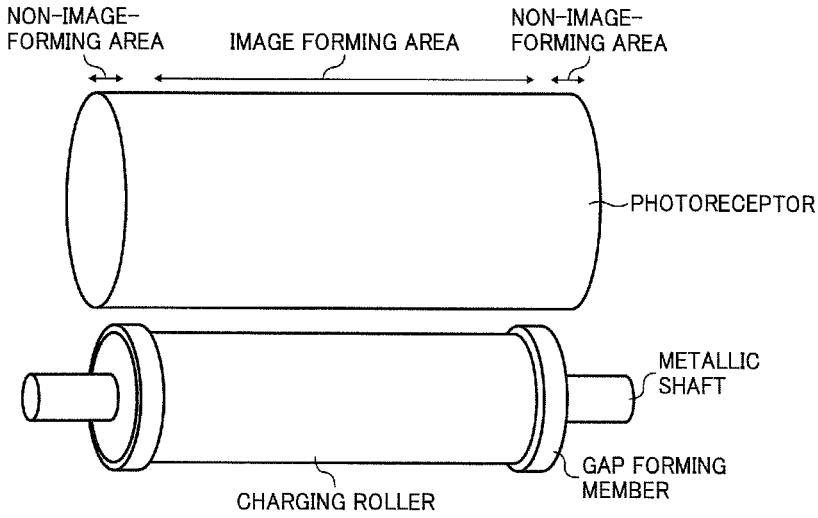
FIG. 5 is a schematic view illustrating an embodiment of the charger for use in the present invention.

As shown in FIG. 5, contaminants are difficult to adhere to or easy to remove a charging roller closely located to a photoreceptor through a gap, and influences thereof can be reduced. The gap is preferably 100 μm or less, and more preferably 50 μm or less. However, since the charging roller does not directly contact a photoreceptor, the charging roller nonuniformly and unstably charges the photoreceptor. Therefore, a DC component overlapped with an AC component stably charges a photoreceptor, which reduces ozone and contamination of the charging roller at the same time.

Suitable light sources for an irradiator (24) and a discharging lamp (22) include general light-emitting materials such as fluorescent lamps, tungsten lamps, halogen lamps, mercury lamps, sodium lamps, LEDs, LDs, light sources using electroluminescence (EL), etc. Among these, LEDs and LDs are mostly used. In addition, in order to obtain light having a desired wave length range, filters such as sharp-cut filters, band pass filters, near-infrared cutting filters, dichroic filters, interference filters, color temperature converting filters can be used.

The above-mentioned light sources can be used for not only the process illustrated in FIG. 4, but also other processes such as a transfer process, a discharging process, a cleaning process, a pre-exposure process include light irradiation to the photoreceptor. However, in the discharging process, the photoreceptor is largely influenced by the irradiation, resulting in occasional deterioration of chargeability and increase of residual potential. Therefore, a reverse bias is optionally applied in the charging process and cleaning process instead of irradiation to discharge, which improves durability of the photoreceptor.

When the photoreceptor positively (or negatively) charged is exposed to imagewise light, an electrostatic latent image having a positive (or negative) charge is formed on the photoreceptor. When the latent image having a positive (or negative) charge is developed with a toner having a negative (or positive) charge, a positive image can be obtained. In contrast, when the latent image having a positive (negative) charge is developed with a toner having a positive (negative) charge, a negative image can be obtained. As the developing method, known developing methods can be used. Further. Known discharging methods can be used as the discharging method.

As the transferer, the above-mentioned chargers can be used, however, a combination of a transfer charger (29) and a separation charger (30) as shown in FIG. 4 is effectively used.

A toner image may be directly transferred onto a paper from the photoreceptor by the transferer, however, in the present invention, an intermediate transfer method in which a toner image on the photoreceptor is transferred onto an intermediate transferer once and onto a paper therefrom is preferably used to improve durability of the photoreceptor or production of images having higher quality. Among contaminants adhering the surface of a photoreceptor, a discharge material generated by charging and an external additive in a toner are vulnerable to humidity and cause abnormal images. A paper powder is also one of materials causing abnormal images, and it adheres to a photoreceptor, incidentally resulting in not only production of abnormal images but also deterioration of abrasion resistance and sectional abrasion of the photoreceptor. Therefore, it is preferable that the photoreceptor does not directly contact a paper in terms of high quality images.

The intermediate transfer method is effectively used for, full-color image forming apparatuses in particular. After plural toner images are formed on the intermediate transferer, they are transferred onto a paper at a time to prevent shifted color, which produces images having higher quality. However, since the intermediate transfer method need four-times scanning to produce a full-color image, the durability of a photoreceptor was a serious problem. The photoreceptor of the present invention is hardly likely to produce blurred images without a drum heater, and therefore effectively and efficiently used in image forming apparatuses using the intermediate transfer method. Any known drum-shaped and belt-shaped intermediate transferers can be used in the present invention, and are effectively and efficiently used for higher durability of a photoreceptor or quality images having higher quality.

When a toner image formed on the photoreceptor (21) by a developing unit (25) is transferred onto a transfer sheet (28), all of the toner image is not transferred thereto, and a residual toner remains on the surface of the photoreceptor (21). The residual toner is removed from the photoreceptor by a fur brush (33) or a cleaning blade (34). The residual toner remaining on the photoreceptor can be removed by only the brush or a combination with the blade. Suitable cleaning brushes include known cleaning brushes such as fur brushes and mag-fur brushes.

The cleaning is a process of removing a toner, etc. remaining on the photoreceptor after transferred onto a transfer sheet as mentioned above, and when the photoreceptor is repeatedly scraped by the blade or the brush, it is abraded and scratched, resulting in occasional production of abnormal images. Defective cleaning contaminates the surface of a photoreceptor, resulting in not only production of abnormal images but also large reduction of a life of the photoreceptor. Particularly, a photoreceptor including a filler in its outer most surface layer to improve abrasion resistance accelerates filming and production of abnormal images because contaminants adhering to the surface of the photoreceptor are difficult to remove. Therefore, the cleanability of a photoreceptor is very effectively increased for higher durability thereof and production of images having higher quality. Methods of reducing a friction coefficient of the surface of a photoreceptor are known as means of increasing the cleanability thereof. The methods of reducing a friction coefficient of the surface of a photoreceptor are classified into methods of including various lubricative materials in the surface of a photoreceptor and methods of externally applying the lubricative materials to the surface thereof. The former can design the layout around the engine more freely and is advantageous for photoreceptors having small diameters. However, the friction coefficient noticeably increases when the photoreceptor is repeatedly used and the continuousness thereof is still a problem. Meanwhile, the latter need an applicator applying the lubricative materials, but are effectively used for higher durability of a photoreceptor because of high stability of the friction coefficient. The latter includes a method of including the lubricative material in a developer to adhere to a photoreceptor in development, which is a very effective means for higher durability of the photoreceptor and production of images having higher quality because of not limiting the layout around the engine and maintaining the continuousness of an effect of the friction coefficient reduction.

Specific examples of the lubricant include lubricative liquids, solids and powders such as silicone oils and fluorine oils; various fluorine-containing resins such as PTFE, PFA and PVDF; silicone resins; polyolefin resins; silicon grease; fluorine grease; paraffin wax; fatty acid esters; metal salts of fatty acid such as zinc stearate; black lead; and molybdenum disulfide. When mixed in a developer, the lubricant needs to be a powder and zinc stearate can very effectively be used in particular because of having less adverse effect. A toner preferably includes a powder of zinc stearate in an amount of from 0.0.1 to 0.5% by weight, and more preferably from 0.1 to 0.3% by weight in consideration of the balance and influence thereof to the toner.

The photoreceptor of the present invention is effectively used in a tandem-type image forming apparatus including plural photoreceptors for respective image developers parallely forming plural color toner images. The tandem-type image forming apparatus including at least 4 color toners, i.e., yellow (Y), magenta (M), cyan (C) and black (K), respective image developers holding them, and at least 4 photoreceptors therefor is capable of printing full-color images at very higher speed than conventional full-color image forming apparatuses.

Figure 6:
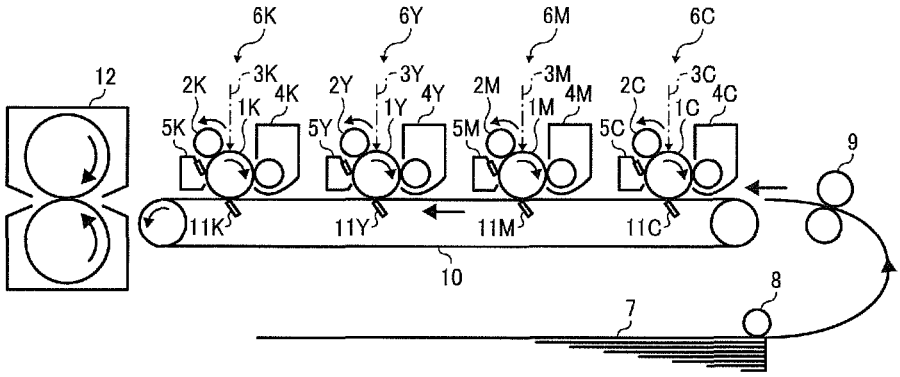
FIG. 6 is a schematic view for explaining the tandem-type full color electrophotographic image forming apparatus of the present invention.

FIG. 6 is a schematic view illustrating an embodiment of the tandem-type full-color image forming apparatus of the present invention, and the following modified embodiment is included in the present invention. In FIG. 6, numerals 1C, 1M, 1Y and 1K represent drum-shaped photoreceptors of the present invention. The photoreceptors 1C, 1M, 1Y and 1K rotate in the direction indicated by an arrow, and around them, chargers 2C, 2M, 2Y and 2K; image developers 4C, 4M, 4Y and 4*k*; and cleaners 5C, 5M, 5Y and 5K are arranged in a rotation order thereof. The chargers 2C, 2M, 2Y and 2K uniformly charge surfaces of the photoreceptors.

Laser beams 3C, 3M, 3Y and 3K from irradiators (not shown) irradiate the surfaces of the photoreceptors between the chargers 2C, 2M, 2Y and 2K and image developers 4C, 4M, 4Y and 4*k* to form electrostatic latent images on the surfaces of the photoreceptors 1C, 1M, 1Y and 1K. Four image forming units 6C, 6M, 6Y and 6K including the photoreceptors 1C, 1M, 1Y and 1K are arranged along a transfer feeding belt 10 feeding a transfer material. The transfer feeding belt 10 contacts the photoreceptors 1C, 1M, 1Y and 1K between the image developers 4C, 4M, 4Y and 4*k* and cleaners 5C, 5M, 5Y and 5K of the image forming units 6C, 6M, 6Y and 6K. Transfer brushes 11*c*, 11M, 11Y and 11K are arranged on a backside of the transfer feeding belt 10, which is an opposite side to the photoreceptors, to apply a transfer bias to the transfer feeding belt 10. The image forming units 6C, 6M, 6Y and 6K just handle different color toners respectively, and have the same structures.

In the full-color electrophotographic apparatus in FIG. 6, images are formed as follows. First, in the image forming units 6C, 6M, 6Y and 6K, the photoreceptors 1C, 1M, 1Y and 1K are charged by the chargers 2C, 2M, 2Y and 2K rotating in the same direction of the photoreceptors. Next, the laser beams 3C, 3M, 3Y and 3K from irradiators (not shown) irradiate the surfaces of the photoreceptors to form electrostatic latent images having different colors respectively thereon.

Then, the image developers 4C, 4M, 4Y and 4*k* develop the electrostatic latent images to form toner images. The image developers 4C, 4M, 4Y and 4*k* develop the electrostatic latent images with toners having a cyan color C, a magenta color M, a yellow color Y and a black color K respectively. The color toner images respectively formed on the photoreceptors 1C, 1M, 1Y and 1K are overlaid on a transfer sheet 7. The transfer sheet 7 is fed by a paper feeding roller 8 from a tray and stopped once by a pair of resist rollers 9, and fed onto the transfer feeding belt 10 in timing with formation of the toner images on the photoreceptors. The transfer sheet 7 borne by the transfer feeding belt 10 is transferred to the contact (transfer) position of each photoreceptor 1C, 1M, 1Y and 1K, where each color toner image is transferred onto the transfer sheet 7.

The toner images on the photoreceptors are transferred to the transfer sheet 7 by an electric field formed with a potential difference between the transfer bias applied by the transfer brushes 11*c*, 11M, 11Y and 11K and the photoreceptors 1C, 1M, 1Y and 1K. The transfer sheet 7 having passed the four transfer positions and bearing the four color toner images overlaid thereon is fed to a fixer 12 fixing the toner images on the transfer sheet. The transfer sheet 7 on which the toner images are fixed is fed onto a sheet receiver (not shown). Residual toners remaining on the photoreceptors 1C, 1M, 1Y and 1K, which were not transferred on the transfer sheet at the transfer position are collected by the cleaners 5C, 5M, 5Y and 5K.

Figure 7:
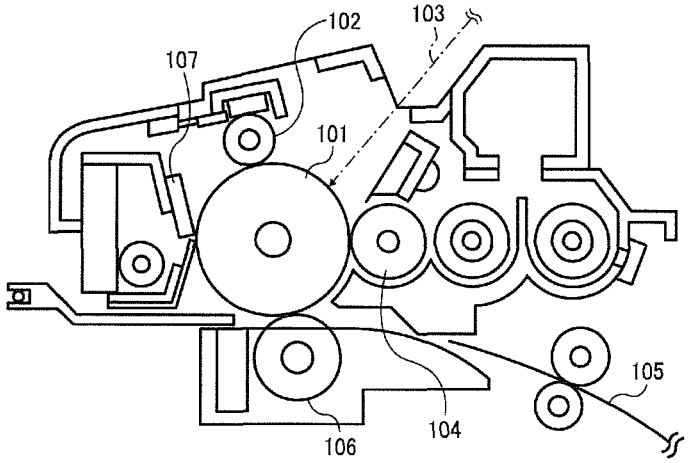
FIG. 7 is a schematic view for explaining the process cartridge for electrophotographic image forming apparatus of the present invention.

In FIG. 6, the image forming units are lined in order of C, M, Y and K from an upstream to a downstream of feeding direction of the transfer sheet. However, the order is not limited thereto and the color orders are optional. When only a black image is produced, the image forming units 6C, 6M and 6Y except for 6K can be stopped in the apparatus of the present invention. In FIG. 7, the charger contacts the photoreceptor, however, a gap therebetween of from 10 to 200 μm can decrease an abrasion amount thereof and toner filming over the charger.

The above-mentioned image forming units may be fixedly set in a copier, a facsimile or a printer. However, the image forming units may be set therein as a process cartridge. The process cartridge means an image forming unit (or device) including at least a photoreceptor, and one of a charger, an imagewise light irradiator, an image developer, an image transferer, a cleaner and a discharger. FIG. 7 is a schematic view illustrating an embodiment of the process cartridge of the present invention, in which numeral 101, 102, 103, 104, 105, 106 and 107 are a photoreceptor of the present invention, a contact charger, an irradiator, an image developer, a transferer, a contact transferer and a cleaning unit, respectively.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Titanylphthalocyanine Pigment

Synthesis Example 1

A pigment was prepared by the method disclosed in Example 1 of Japanese published unexamined application No. 2004-83859. Specifically, 292 parts of 1,3-diiminoisoindoline and 1,800 parts of sulfolane were mixed to prepare a mixture, and 204 parts of titanium tetrabutoxide was dropped into the mixture under a nitrogen gas flow. The mixture was then gradually heated to have a temperature of 180° C. and a reaction was performed for 5 hours at a temperature of from 170 to 180° C. while agitating. After the reaction, the reaction product was cooled, followed by filtering. The thus prepared wet cake was washed with chloroform until the cake colored blue. Then the cake was washed several times with methanol, followed by washing several times with hot water heated to 80° C. and drying to prepare a crude titanylphthalocyanine.

60 parts of the crude titanylphthalocyanine pigment was stirred mixed and dissolved in 1,000 parts of sulfonic acid having a concentration of 96%, and filtered to prepare a sulfonic acid solution. The sulfonic acid solution was dropped in 35,000 parts of iced water while stirred and a precipitated crystal was filtered. Then, the crystal was repeatedly washed with water until the water became neutral to prepare an aqueous paste of a titanylphthalocyanine pigment.

1,500 parts of tetrahydrofuran were added to the aqueous paste and the mixture was strongly agitated with a HOMOMIXER (MARK IIf from Kenis Ltd.) at a revolution of 2,000 rpm until the color of the paste was changed from navy blue to light blue. The color was changed after the agitation was performed for about 20 minutes. The dispersion was then filtered under a reduced pressure. The thus obtained crystal on the filter was washed with tetrahydrofuran to prepare 98 parts of a wet cake of the pigment. The wet cake was dried for 2 days at 70° C. under a reduced pressure of 5 mmHg to prepare 78 parts of a titanylphthalocyanine pigment.

Figure 8:
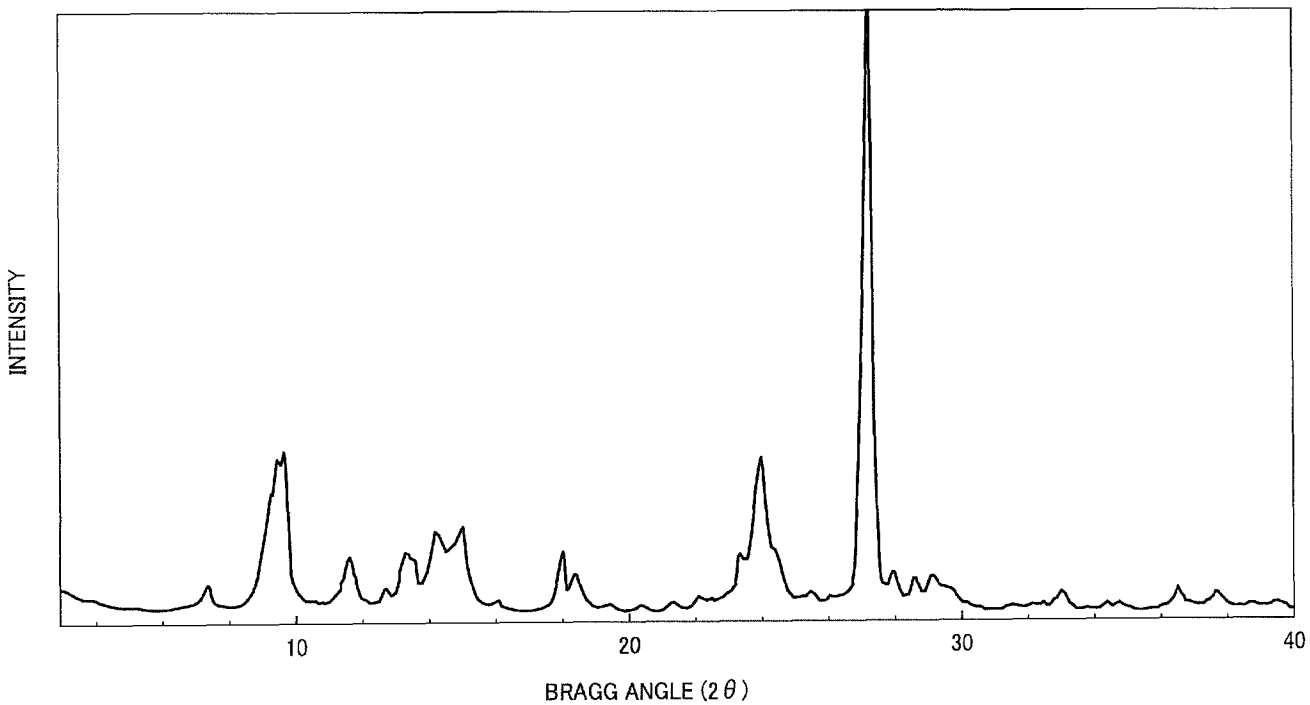
FIG. 8 is a diagram showing an X-ray spectrum of the titanylphthalocyanine crystal prepared in Synthesis Example 1.

X-ray diffraction spectrum of the titanylphthalocyanine powder was measured by the following conditions to find that a maximum peak is observed at a Bragg (2θ) angle of 27.2±0.2°, a lowest angle peak at an angle of 7.3±0.2°, and a main peak at each of angles of 9.4±0.2°, 9.6±0.2°, and 24.0±0.2°, wherein no peak is observed between the peaks of 7.3° and 9.4° and at an angle of 26.3°. The result is shown in FIG. 8.

<X-Ray Diffraction Spectrum Measurement Conditions>

X-ray tube: Cu
Voltage: 50 kV
Current: 30 mA
Scanning speed: 2°/min
Scanning range: 3 to 40°
Time constant: 2 sec <Preparation of Dispersion of Titanylphthalocyanine and Polyvinylacetal Resin>

(Preparation of Dispersion 1)

The following materials were dispersed by beads milling to prepare a dispersion 1.

| | |
|---|---|
| Titanylphthalocyanine Pigment Prepared in Synthesis Example 1 | 37.5 |
| Polyvinylbutyral (BX-1 from Sekisui Chemical Co., Ltd.) | 12.5 |
| 2-butanone | 500 |

Specifically, polyvinylbutyral was dissolved in 2-butanone to prepare a solution, and the solution and the pigment were placed in a beads mill disperser DISPERMAT SL-C-EX 5-200 from VMA-Getzmann GmbH and dispersed with zirconia beads having a diameter of 0.5 mm at 3,000 rpm for 4 hrs. Then, 1,250 parts of 2-butanone were placed in the beads mill disperser to prepare a dispersion 1.

(Preparation of Dispersion 2)

The procedure for preparation of dispersion 1 was repeated to prepare a dispersion 2 except for changing the formulation of the dispersion as follows.

| | |
|---|---|
| Titanylphthalocyanine Pigment Prepared in Synthesis Example 1 | 25 |
| Polyvinylbutyral (BX-1 from Sekisui Chemical Co., Ltd.) | 25 |
| 2-butanone | 500 |

(Preparation of Dispersion 3)

The procedure for preparation of dispersion 1 was repeated to prepare a dispersion 3 except for changing the formulation of the dispersion as follows.

| | |
|---|---|
| Titanylphthalocyanine Pigment Prepared in Synthesis Example 1 | 25 |
| Polyvinylbutyral (BH-3 from Sekisui Chemical Co., Ltd.) | 25 |
| 2-butanone | 500 |

(Preparation of Dispersion 4)

The procedure for preparation of dispersion 1 was repeated to prepare a dispersion 4 except for changing the formulation of the dispersion as follows.

| | |
|---|---|
| Titanylphthalocyanine Pigment Prepared in Synthesis Example 1 | 25 |
| Polyvinylbutyral (BH-S from Sekisui Chemical Co., Ltd.) | 25 |
| 2-butanone | 500 |

(Preparation of Dispersion 5)

The procedure for preparation of dispersion 1 was repeated to prepare a dispersion 5 except for changing the formulation of the dispersion as follows.

| | |
|---|---|
| Titanylphthalocyanine Pigment Prepared in Synthesis Example 1 | 25 |
| Polyvinylbutyral | 25 |

-continued

| | |
|---|---|
| (BM-1 from Sekisui Chemical Co., Ltd.) | |
| 2-butanone | 500 |

(Preparation of Dispersion 6)

The procedure for preparation of dispersion 1 was repeated to prepare a dispersion 6 except for changing the formulation of the dispersion as follows.

| | |
|---|---|
| Titanylphthalocyanine Pigment Prepared in Synthesis Example 1 | 25 |
| Polyvinylbutyral (BL-1 from Sekisui Chemical Co., Ltd.) | 25 |
| 2-butanone | 500 |

The polyvinylbutyral resins used in the dispersions have the following formula (A) and properties shown in Table 1.

TABLE 1

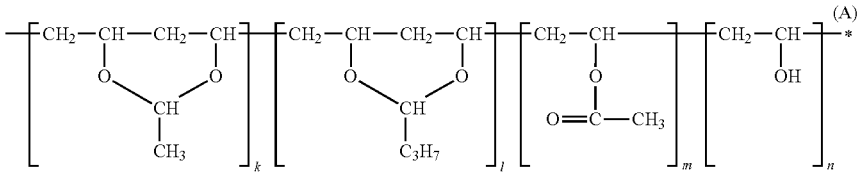

(A)

| | Average molecular weight | K in formula (A) | 1 in formula (A) | K + 1 in formula (A) (k and 1 are not 0) | m in formula (A) | n in formula (A) |
|---|---|---|---|---|---|---|
| BX-1 | 100,000 | — | — | 0.66 | 0.02 | 0.33 |
| BH-3 | 110,000 | 0.0 | 0.64 | — | 0.02 | 0.34 |
| BH-S | 66,000 | 0.0 | 0.73 | — | 0.0.5 | 0.22 |
| BM-1 | 40,000 | 0.0 | 0.64 | — | 0.02 | 0.34 |
| BL-1 | 19,000 | 0.0 | 0.62 | — | 0.02 | 0.36 |

The volume-average particle diameters of the titanylphthalocyanine pigments thus prepared were measured with an ultracentrifugal automatic particle diameter distribution measurer CAPA-700 from Horiba Ltd. The results are shown in Table 2.

TABLE 2

| Dispersion | Average particle diameter (μm) |
|---|---|
| Dispersion 1 | 0.22 |
| Dispersion 2 | 0.21 |
| Dispersion 3 | 0.23 |
| Dispersion 4 | 0.24 |
| Dispersion 5 | 0.26 |
| Dispersion 6 | 0.31 |

Example 1

An undercoat layer coating liquid, a CGL coating liquid and CTL coating liquid having the following formulations were coated and dried in this order on an aluminum cylinder having a diameter of 100 mm and a length of 360 mm as a substrate to prepare a multilayer photoreceptor having an undercoat layer 3.5 μm thick, a CGL, and a CTL 23 μm thick.

The CGL had a thickness so as to have a light transmittance of 20% for light having a wavelength of 780 nm. The transmittance was measured by a marketed spectrophotometer UV-3100 from Shimadzu Corp. with light having a wavelength of 780 nm for an aluminium cylinder wounded with a polyethyleneterephthalate film and coated with the following CGL coating liquid, and a polyethyleneterephthalate film not coated with the CGL coating liquid. After each layer was coated and dried until it does not feel sticky with a finger, the undercoat layer, CGL and CTL were dried at 130° C. for 20 min, 135° C. for 40 min and 120° C. for 20 min to prepare an electrophotographic photoreceptor 1.

Example 2

The procedure for preparation of the electrophotographic photoreceptor 1 in Example 1 was repeated to prepare an electrophotographic photoreceptor 2 except for changing the formulation of the CGL coating liquid as follows.

| (CGL Coating Liquid) | |
|---|---|
| Dispersion 2 | 10 |
| Isocyanate compound having the following formula (5)-1 | 0.14 |

| (Undercoat Layer Coating Liquid) | |
|---|---|
| Titanium oxide<br>(CR-EL from Ishihara Sangyo Kaisha, ltd.) | 50 |
| Alkyd resin<br>(Bekkolite M6401-50 including a solid content of 50% by weight from Dainippon Ink And Chemicals, inc.) | 14 |
| Melamine resin<br>(Super Bekkamin L-145-60 including a solid content 60% by weight from Dainippon Ink And Chemicals, inc.) | 8 |
| 2-butanone | 120 |
| (CGL Coating Liquid) | |
| Dispersion 1 | 10 |
| Isocyanate compound having the following formula (5)-1 | 0.07 |

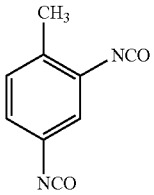

(5)-1

| (CTL Coating Liquid) | |
|---|---|
| Bisphenol Z polycarbonate<br>(Panlite TS-2050 from TEIJIN CHEMICALS LTD.) | 10 |
| CTM having the following formula (8) | |

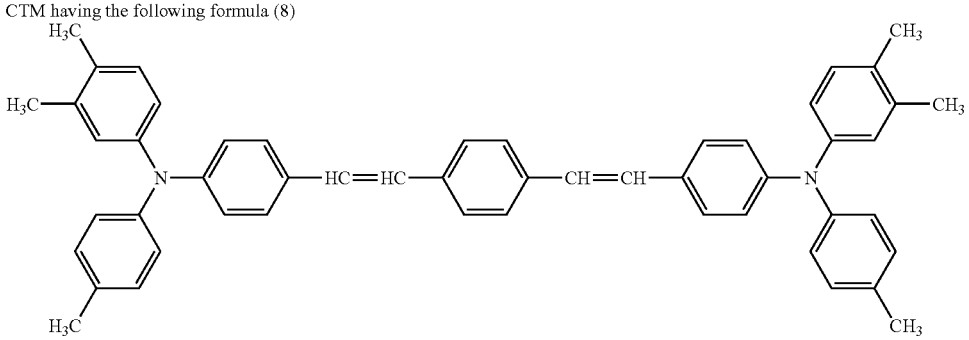

(8)

| | |
|---|---|
| Tetrahydrofuran | 80 |
| 1% silicone oil solution in tetrahydrofuran<br>(KF50-100CS from Shin-Etsu Chemical Industry Co., Ltd.) | 0.2 |

-continued (CGL Coating Liquid)

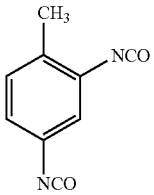

(5)-1

Example 3

The procedure for preparation of the electrophotographic photoreceptor 2 in Example 2 was repeated to prepare an electrophotographic photoreceptor 3 except for replacing the dispersion 2 with the dispersion 3.

Example 4

The procedure for preparation of the electrophotographic photoreceptor 2 in Example 2 was repeated to prepare an electrophotographic photoreceptor 4 except for replacing the dispersion 2 with the dispersion 4.

Example 5

The procedure for preparation of the electrophotographic photoreceptor 2 in Example 2 was repeated to prepare an electrophotographic photoreceptor 5 except for replacing the dispersion 2 with the dispersion 5.

Example 6

The procedure for preparation of the electrophotographic photoreceptor 2 in Example 2 was repeated to prepare an electrophotographic photoreceptor 6 except for replacing the dispersion 2 with the dispersion 6.

Example 7

The procedure for preparation of the electrophotographic photoreceptor 2 in Example 2 was repeated to prepare an electrophotographic photoreceptor 7 except for changing the parts by weight of the isocyanate compound from 0.14 to 0.07.

Example 8

The procedure for preparation of the electrophotographic photoreceptor 2 in Example 2 was repeated to prepare an electrophotographic photoreceptor 8 except for changing the parts by weight of the isocyanate compound from 0.14 to 0.3.

Example 9

The procedure for preparation of the electrophotographic photoreceptor 2 in Example 2 was repeated to prepare an electrophotographic photoreceptor 9 except for replacing the isocyanate compound with an isocyanate compound having the following formula (5)-5.

(5)-5

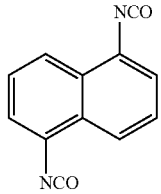

Example 10

The procedure for preparation of the electrophotographic photoreceptor 2 in Example 2 was repeated to prepare an electrophotographic photoreceptor 10 except for replacing the isocyanate compound with an isocyanate compound having the following formula (5)-7.

(5)-7

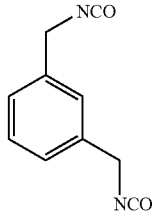

Example 11

The procedure for preparation of the electrophotographic photoreceptor 2 in Example 2 was repeated to prepare an electrophotographic photoreceptor 11 except for replacing the isocyanate compound with an isocyanate compound having the following formula (6)-1.

(6)-1

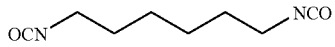

Example 12

The procedure for preparation of the electrophotographic photoreceptor 2 in Example 2 was repeated to prepare an electrophotographic photoreceptor 12 except for replacing the isocyanate compound with an isocyanate compound having the following formula (6)-2.

(6)-2

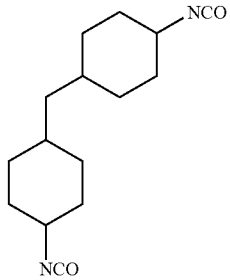

Example 13

The procedure for preparation of the electrophotographic photoreceptor 2 in Example 2 was repeated to prepare an electrophotographic photoreceptor 13 except for replacing the isocyanate compound with an isocyanate compound having the following formula (7)-2.

(7)-2

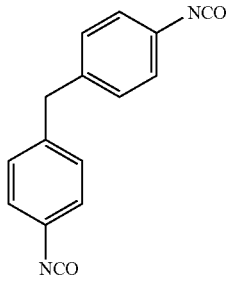

Example 14

The procedure for preparation of the electrophotographic photoreceptor 2 in Example 2 was repeated to prepare an electrophotographic photoreceptor 14 except for replacing the isocyanate compound with an isocyanate compound having the following formula (7)-11.

(7)-11

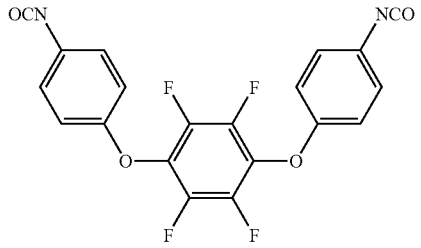

Comparative Example 1

The procedure for preparation of the electrophotographic photoreceptor 1 in Example 1 was repeated to prepare an electrophotographic photoreceptor 15 except for not including the isocyanate compound in the CGL coating liquid.

Comparative Example 2

The procedure for preparation of the electrophotographic photoreceptor 2 in Example 2 was repeated to prepare an electrophotographic photoreceptor 16 except for not including the isocyanate compound in the CGL coating liquid.

Comparative Example 3

The procedure for preparation of the electrophotographic photoreceptor 3 in Example 3 was repeated to prepare an electrophotographic photoreceptor 17 except for not including the isocyanate compound in the CGL coating liquid.

Comparative Example 4

The procedure for preparation of the electrophotographic photoreceptor 4 in Example 4 was repeated to prepare an electrophotographic photoreceptor 18 except for not including the isocyanate compound in the CGL coating liquid.

Comparative Example 5

The procedure for preparation of the electrophotographic photoreceptor 5 in Example 5 was repeated to prepare an electrophotographic photoreceptor 19 except for not including the isocyanate compound in the CGL coating liquid.

Comparative Example 6

The procedure for preparation of the electrophotographic photoreceptor 6 in Example 6 was repeated to prepare an electrophotographic photoreceptor 20 except for not including the isocyanate compound in the CGL coating liquid.

Comparative Example 7

The procedure for preparation of the electrophotographic photoreceptor 1 in Example 1 was repeated to prepare an electrophotographic photoreceptor 21 except for changing the formulation of the CGL coating as follows.

| (CGL Coating Liquid) | |
|---|---|
| Dispersion 2 | 10 |
| Melamine resin | 0.23 |

(Super Bekkamin L-145-60 including a solid content 60% by weight from Dainippon Ink And Chemicals, inc.)

Comparative Example 8

The procedure for preparation of the electrophotographic photoreceptor 1 in Example 1 was repeated to prepare an electrophotographic photoreceptor 22 except for changing the formulation of the CGL coating as follows.

| (CGL Coating Liquid) | |
|---|---|
| Dispersion 6 | 10 |
| Melamine resin | 0.23 |

(Super Bekkamin L-145-60 including a solid content 60% by weight from Dainippon Ink And Chemicals, inc.)

<Crosslinkage Degree of CGL>

Each of the CGLs alone of Examples 1 to 14 and Comparative Examples 1 to 8 was formed on an aluminum plate, dipped in tetrahydrofuran for 24 hrs, and dried in a vacuum at 60° C. for 6 hrs to fully volatilize the solvent. A weight ratio of the CGL after dipped to the CGL before dipped was measured to determine a gel fraction of the insoluble CGL. The results are shown in Table 3.

TABLE 3

| | Gel Fraction [%] |
|---|---|
| Example 1 | 90 |
| Example 2 | 95 |
| Example 3 | 95 |
| Example 4 | 90 |
| Example 5 | 95 |
| Example 6 | 95 |
| Example 7 | 85 |
| Example 8 | 100 |
| Example 9 | 90 |
| Example 10 | 90 |

TABLE 3-continued

| | Gel Fraction [%] |
|---|---|
| Example 11 | 90 |
| Example 12 | 95 |
| Example 13 | 90 |
| Example 14 | 95 |
| Comparative Example 1 | 0 |
| Comparative Example 2 | 0 |
| Comparative Example 3 | 0 |
| Comparative Example 4 | 0 |
| Comparative Example 5 | 0 |
| Comparative Example 6 | 0 |
| Comparative Example 7 | 80 |
| Comparative Example 8 | 75 |

<Running Test>

Each of the electrophotographic photoreceptor 1 to 22 was installed in a process cartridge, and which was installed in modified imagio Neo 751 from Ricoh Company, Ltd. having a process linear speed of 350 mm/sec to measure bright section potential, bright section potentials in an environment of high temperature and high humidity, and in that of low temperature and low humidity, and to evaluate background fouling. The background fouling was evaluated after 300,000 images (A4, My Paper from NBS Ricoh Co., Ltd. and initial charge potential −800V) were produced. The bright section potentials and the background fouling were evaluated under the following conditions.

The developing unit was taken apart, and a potential meter probe connected to a surface potential meter was fitted on the developing unit so as to have a distance of 50 mm from the upper end or lower end of a photoreceptor. The photoreceptor was set in the developing unit, a grid potential was adjusted such that a dark section potential was −800 V, and a black solid image was produced to measure the bright section potentials having a distance of 50 mm from the upper end and the lower end of the photoreceptor. A difference ΔVL between the bright section potentials VL [−V] having a distance of 50 mm from the upper end and the lower end is shown in Table 4. TREK MODEL 344 was used as the surface potential meter. The evaluation was performed at room temperature.

In addition, after each of the photoreceptors was left in an environment of high temperature (30° C.) and high humidity (90%) (HH) or low temperature (10° C.) and low humidity (15%) (LL) for 24 hrs, the bright section potential was measured under the same environment. The developing unit was taken apart, and a potential meter probe connected to a surface potential meter was fitted on the developing unit so as to have a distance of 120 mm from the upper end of a photoreceptor. The photoreceptor was set in the developing unit, a grid potential was adjusted such that a dark section potential was −800 V, and a black solid image was produced to measure the bright section potentials having a distance of 50 mm from the upper and the lower end of the photoreceptor. TREK MODEL 344 was used as the surface potential meter.

The background fouling (BF) before and after 300,000 blank solid images (not irradiated) were produced was visually observed to evaluate under the following standard.

Good: Image quality scarcely deteriorated

Poor: Deterioration of image quality was visually observable

Bad: Image quality had serious problem

TABLE 4

| | PR | ΔVL | HH VL [-V] | LL VL [-V] | BF (Initial) | BF (after 300,000) |
|---|---|---|---|---|---|---|
| Example 1 | 1 | 5 | 30 | 45 | Good | Good |
| Example 2 | 2 | 0 | 35 | 40 | Good | Good |
| Example 3 | 3 | 0 | 45 | 55 | Good | Good |
| Example 4 | 4 | 0 | 45 | 60 | Good | Good |
| Example 5 | 5 | 0 | 40 | 50 | Good | Good |
| Example 6 | 6 | 0 | 45 | 55 | Good | Good |
| Example 7 | 7 | 10 | 35 | 45 | Good | Good |
| Example 8 | 8 | 0 | 40 | 45 | Good | Good |
| Example 9 | 9 | 5 | 45 | 60 | Good | Good |
| Example 10 | 10 | 5 | 45 | 55 | Good | Good |
| Example 11 | 11 | 5 | 65 | 70 | Good | Good |
| Example 12 | 12 | 0 | 65 | 70 | Good | Good |
| Example 13 | 13 | 0 | 60 | 65 | Good | Good |
| Example 14 | 14 | 5 | 70 | 70 | Good | Good |
| Comparative Example 1 | 15 | 20 | 35 | 85 | Good | Bad |
| Comparative Example 2 | 16 | 20 | 30 | 80 | Good | Bad |
| Comparative Example 3 | 17 | 20 | 35 | 95 | Good | Bad |
| Comparative Example 4 | 18 | 20 | 40 | 75 | Good | Bad |
| Comparative Example 5 | 19 | 25 | 35 | 90 | Good | Bad |
| Comparative Example 6 | 20 | 30 | 40 | 95 | Good | Bad |
| Comparative Example 7 | 21 | 10 | 100 | 120 | Good | Poor |
| Comparative Example 8 | 22 | 15 | 115 | 130 | Good | Poor |

PR: Photoreceptor

Example 15

An undercoat layer coating liquid, a CGL coating liquid and CTL coating liquid having the following formulations were coated and dried in this order on an aluminum cylinder having a diameter of 100 mm and a length of 360 mm as a substrate to prepare a multilayer photoreceptor having an undercoat layer 3.5 μm thick, a CGL, and a CTL 23 μm thick.

The CGL was formed 30 days after the following CGL coating liquid was prepared.

The CGL had a thickness so as to have a light transmittance of 20% for light having a wavelength of 780 nm. The transmittance was measured by a marketed spectrophotometer UV-3100 from Shimadzu Corp. with light having a wavelength of 780 nm for an aluminium cylinder wounded with a polyethyleneterephthalate film and coated with the following CGL coating liquid, and a polyethyleneterephthalate film not coated with the CGL coating liquid. After each layer was coated and dried until it does not feel sticky with a finger, the undercoat layer, CGL and CTL were dried at 130° C. for 20 min, 135° C. for 40 min and 120° C. for 20 min to prepare an electrophotographic photoreceptor 23.

| (Undercoat Layer Coating Liquid) | |
|---|---|
| Titanium oxide | 50 |
| (CR-EL from Ishihara Sangyo Kaisha, ltd.) | |
| Alkyd resin | 14 |
| (Bekkolite M6401-50 including a solid content of 50% by weight from Dainippon Ink And Chemicals, inc.) | |

-continued

| | |
|---|---|
| Melamine resin<br>(Super Bekkamin L-145-60 including a solid content 60% by weight from Dainippon Ink And Chemicals, inc.) | 8 |
| 2-butanone | 120 |
| (CGL Coating Liquid 1) | |

| | |
|---|---|
| | 10 |
| Dispersion 1 | |
| Isocyanate compound having the following formula (4)-1 | 0.07 |

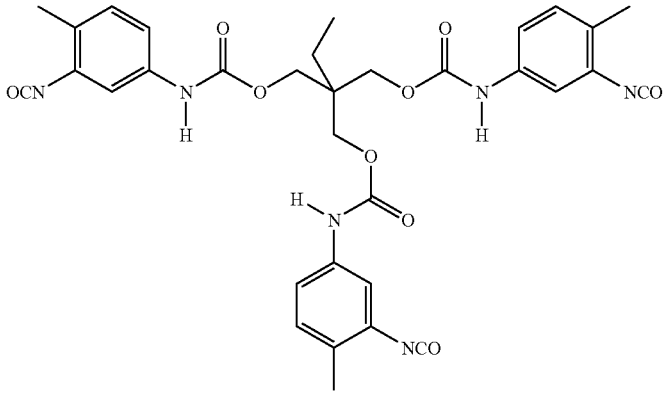

(4)-1

| | |
|---|---|
| (CTL Coating Liquid) | |
| Bisphenol Z polycarbonate<br>(Panlite TS-2050 from TEIJIN CHEMICALS LTD.) | 10 |
| CTM having the following formula (9) | |

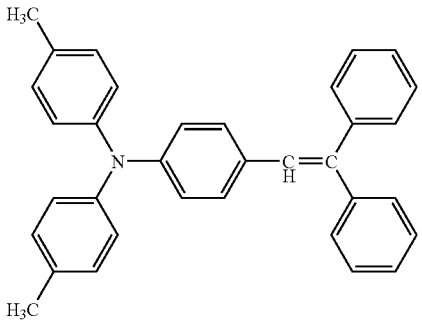

(9)

| | |
|---|---|
| Tetrahydrofuran | 80 |
| 1% silicone oil solution in tetrahydrofuran<br>(KF50-100CS from Shin-Etsu Chemical Industry Co., Ltd.) | 0.2 |

Example 16

The procedure for preparation of the electrophotographic photoreceptor 23 in Example 15 was repeated to prepare an electrophotographic photoreceptor 24 except for changing the formulation of the CGL coating liquid 1 as follows to prepare a CGL coating liquid 2.

| (CGL Coating Liquid 2) | |
|---|---|
| Dispersion 2 | 10 |
| Isocyanate compound having the following formula (4)-1 | 0.14 |

-continued (CGL Coating Liquid 2)

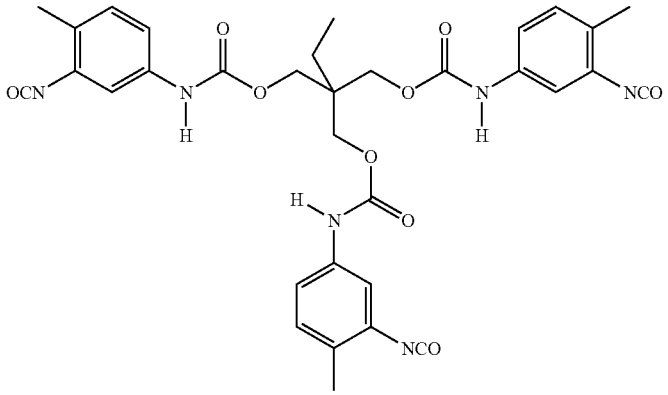

(4)-1

Example 17

The procedure for preparation of the electrophotographic photoreceptor 24 in Example 16 was repeated to prepare an electrophotographic photoreceptor 25 except for replacing the dispersion 2 with the dispersion 3 to prepare a CGL coating liquid 3.

Example 18

The procedure for preparation of the electrophotographic photoreceptor 24 in Example 16 was repeated to prepare an electrophotographic photoreceptor 26 except for replacing the dispersion 2 with the dispersion 4 to prepare a CGL coating liquid 4.

Example 19

The procedure for preparation of the electrophotographic photoreceptor 24 in Example 16 was repeated to prepare an electrophotographic photoreceptor 27 except for replacing the dispersion 2 with the dispersion 5 to prepare a CGL coating liquid 5.

Example 20

The procedure for preparation of the electrophotographic photoreceptor 24 in Example 16 was repeated to prepare an electrophotographic photoreceptor 28 except for replacing the dispersion 2 with the dispersion 6 to prepare a CGL coating liquid 6.

Example 21

The procedure for preparation of the electrophotographic photoreceptor 24 in Example 16 was repeated to prepare an electrophotographic photoreceptor 29 except for changing the parts by weight of the isocyanate compound from 0.14 to 0.07 to prepare a CGL coating liquid 7.

Example 22

The procedure for preparation of the electrophotographic photoreceptor 24 in Example 16 was repeated to prepare an electrophotographic photoreceptor 30 except for changing the parts by weight of the isocyanate compound from 0.14 to 0.3 to prepare a CGL coating liquid 8.

Example 23

The procedure for preparation of the electrophotographic photoreceptor 24 in Example 16 was repeated to prepare an electrophotographic photoreceptor 31 except for replacing the isocyanate compound with an isocyanate compound having the following formula (4)-5 to prepare a CGL coating liquid 9.

(4)-5

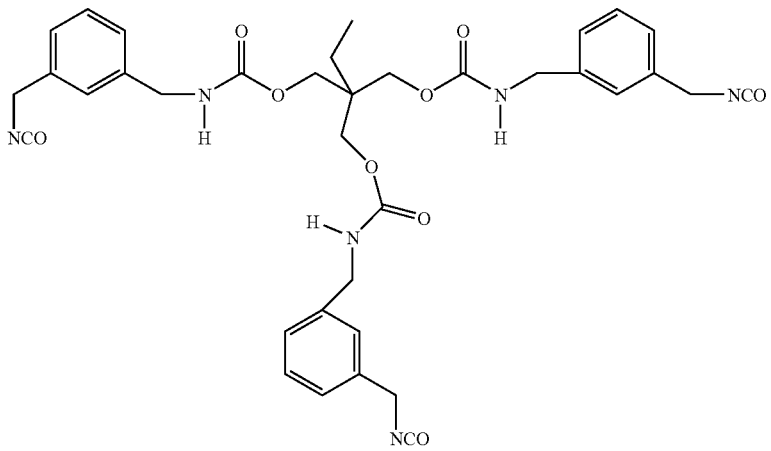

Example 24

The procedure for preparation of the electrophotographic photoreceptor 24 in Example 16 was repeated to prepare an electrophotographic photoreceptor 32 except for replacing the isocyanate compound with an isocyanate compound having the following formula (4)-8 to prepare a CGL coating liquid 10.

(4)-8

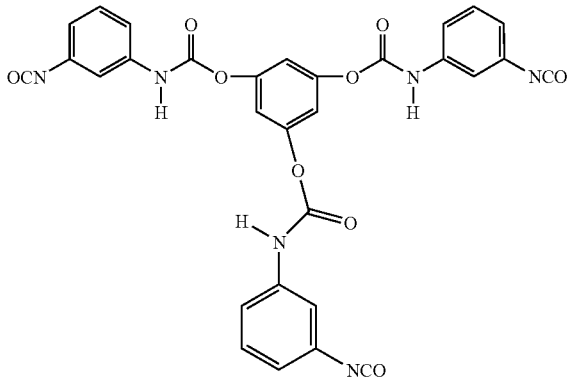

Comparative Example 9

The procedure for preparation of the electrophotographic photoreceptor 23 in Example 15 was repeated to prepare an electrophotographic photoreceptor 33 except for not including the isocyanate compound in the CGL coating liquid to prepare a CGL coating liquid 11.

Comparative Example 10

The procedure for preparation of the electrophotographic photoreceptor 24 in Example 16 was repeated to prepare an electrophotographic photoreceptor 34 except for not including the isocyanate compound in the CGL coating liquid to prepare a CGL coating liquid 12.

Comparative Example 11

The procedure for preparation of the electrophotographic photoreceptor 25 in Example 17 was repeated to prepare an electrophotographic photoreceptor 35 except for not including the isocyanate compound in the CGL coating liquid to prepare a CGL coating liquid 13.

Comparative Example 12

The procedure for preparation of the electrophotographic photoreceptor 26 in Example 18 was repeated to prepare an electrophotographic photoreceptor 36 except for not including the isocyanate compound in the CGL coating liquid to prepare a CGL coating liquid 14.

Comparative Example 13

The procedure for preparation of the electrophotographic photoreceptor 27 in Example 19 was repeated to prepare an electrophotographic photoreceptor 37 except for not including the isocyanate compound in the CGL coating liquid to prepare a CGL coating liquid 15.

Comparative Example 14

The procedure for preparation of the electrophotographic photoreceptor 28 in Example 20 was repeated to prepare an electrophotographic photoreceptor 38 except for not including the isocyanate compound in the CGL coating liquid to prepare a CGL coating liquid 16.

Example 25

The procedure for preparation of the electrophotographic photoreceptor 24 in Example 16 was repeated to prepare an electrophotographic photoreceptor 39 except for replacing the isocyanate compound with an isocyanate compound having the following formula (5)-1 to prepare a CGL coating liquid 17.

(5)-1

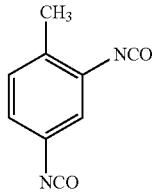

Example 26

The procedure for preparation of the electrophotographic photoreceptor 24 in Example 16 was repeated to prepare an electrophotographic photoreceptor 40 except for replacing the isocyanate compound with an isocyanate compound having the following formula (5)-7 to prepare a CGL coating liquid 18.

(5)-7

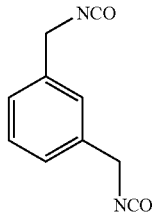

<Crosslinkage Degree of CGL>

Each of the CGLs alone of Examples 15 to 26 and Comparative Examples 9 to 14 was formed on an aluminum plate, dipped in tetrahydrofuran for 24 hrs, and dried in a vacuum at 60° C. for 6 hrs to fully volatilize the solvent. A weight ratio of the CGL after dipped to the CGL before dipped was measured to determine a gel fraction of the insoluble CGL. The results are shown in Table 5.

TABLE 5

| | Gel Fraction [%] |
|---|---|
| Example 15 | 90 |
| Example 16 | 95 |
| Example 17 | 95 |
| Example 18 | 80 |
| Example 19 | 95 |
| Example 20 | 95 |

TABLE 5-continued

| | Gel Fraction [%] |
|---|---|
| Example 21 | 85 |
| Example 22 | 100 |
| Example 23 | 90 |
| Example 24 | 90 |
| Comparative Example 9 | 0 |
| Comparative Example 10 | 0 |
| Comparative Example 11 | 0 |
| Comparative Example 12 | 0 |
| Comparative Example 13 | 0 |
| Comparative Example 14 | 0 |
| Example 25 | 95 |
| Example 26 | 95 |

<Temporal Stability of CGL Coating Liquids>

Volume-average particle diameters of the titanylphthalocyanine pigment in each of the CGL coating liquids right and 30 days after prepared were measured by CAPA-700 from Horiba, Ltd. to evaluate stability of the liquids. The results are shown in Table 6.

TABLE 6

| | CGL coating liquid | Right after prepared [μm] | 30 days after prepared [μm] |
|---|---|---|---|
| Example 15 | 1 | 0.22 | 0.23 |
| Example 16 | 2 | 0.21 | 0.21 |
| Example 17 | 3 | 0.23 | 0.23 |
| Example 18 | 4 | 0.24 | 0.24 |
| Example 19 | 5 | 0.26 | 0.27 |
| Example 20 | 6 | 0.31 | 0.33 |
| Example 21 | 7 | 0.21 | 0.21 |
| Example 22 | 8 | 0.21 | 0.22 |
| Example 23 | 9 | 0.21 | 0.20 |
| Example 24 | 10 | 0.21 | 0.21 |
| Comparative Example 9 | 11 | 0.22 | 0.23 |
| Comparative Example 10 | 12 | 0.21 | 0.22 |
| Comparative Example 11 | 13 | 0.23 | 0.23 |
| Comparative Example 12 | 14 | 0.24 | 0.24 |
| Comparative Example 13 | 15 | 0.26 | 0.26 |
| Comparative Example 14 | 16 | 0.31 | 0.33 |
| Example 25 | 17 | 0.21 | 0.54 |
| Example 26 | 18 | 0.21 | 0.50 |

<Running Test>

Each of the electrophotographic photoreceptor 23 to 40 was installed in a process cartridge, and which was installed in modified imagio Neo 751 from Ricoh Company, Ltd. having a process linear speed of 350 mm/sec to measure bright section potential, bright section potentials in an environment of high temperature and high humidity, and in that of low temperature and low humidity, and to evaluate background fouling. The background fouling was evaluated after 300,000 images (A4, My Paper from NBS Ricoh Co., Ltd. and initial charge potential −800V) were produced. The bright section potentials and the background fouling were evaluated under the following conditions.

The developing unit was taken apart, and a potential meter probe connected to a surface potential meter was fitted on the developing unit so as to have a distance of 50 mm from the upper end or lower end of a photoreceptor. The photoreceptor was set in the developing unit, a grid potential was adjusted such that a dark section potential was −800 V, and a black solid image was produced to measure the bright section potentials having a distance of 50 mm from the upper end and the lower end of the photoreceptor. A difference ΔVL between the bright section potentials VL [−V] having a distance of 50 mm from the upper end and the lower end is shown in Table 7. TREK MODEL 344 was used as the surface potential meter. The evaluation was performed at room temperature.

In addition, after each of the photoreceptors was left in an environment of high temperature (30° C.) and high humidity (90%) (HH) or low temperature (10° C.) and low humidity (15%) (LL) for 24 hrs, the bright section potential was measured under the same environment. The developing unit was taken apart, and a potential meter probe connected to a surface potential meter was fitted on the developing unit so as to have a distance of 120 mm from the upper end of a photoreceptor. The photoreceptor was set in the developing unit, a grid potential was adjusted such that a dark section potential was −800 V, and a black solid image was produced to measure the bright section potentials having a distance of 50 mm from the upper end and the lower end of the photoreceptor. TREK MODEL 344 was used as the surface potential meter.

The background fouling (BF) before and after 300,000 blank solid images (not irradiated) were produced was visually observed to evaluate under the following standard.

Good: Image quality scarcely deteriorated

Poor: Deterioration of image quality was visually observable

Bad: Image quality had serious problem

TABLE 7

| | PR | ΔVL | HH VL [-V] | LL VL [-V] | BF (Initial) | BF (after 300,000) |
|---|---|---|---|---|---|---|
| Example 15 | 23 | 5 | 55 | 65 | Good | Good |
| Example 16 | 24 | 0 | 55 | 70 | Good | Good |
| Example 17 | 25 | 0 | 60 | 70 | Good | Good |
| Example 18 | 26 | 10 | 60 | 75 | Good | Good |
| Example 19 | 27 | 0 | 60 | 70 | Good | Good |
| Example 20 | 28 | 0 | 60 | 75 | Good | Good |
| Example 21 | 29 | 10 | 50 | 65 | Good | Good |
| Example 22 | 30 | 0 | 60 | 65 | Good | Good |
| Example 23 | 31 | 5 | 65 | 80 | Good | Good |
| Example 24 | 32 | 5 | 65 | 75 | Good | Good |
| Comparative Example 9 | 33 | 20 | 30 | 80 | Good | Bad |
| Comparative Example 10 | 34 | 20 | 30 | 80 | Good | Bad |
| Comparative Example 11 | 35 | 20 | 35 | 85 | Good | Bad |
| Comparative Example 12 | 36 | 20 | 40 | 85 | Good | Bad |
| Comparative Example 13 | 37 | 25 | 50 | 90 | Good | Bad |
| Comparative Example 14 | 38 | 30 | 40 | 95 | Good | Bad |
| Example 25 | 39 | 5 | 85 | 100 | Good | Poor |
| Example 26 | 40 | 0 | 85 | 105 | Good | Poor |

PR: Photoreceptor

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2008-300835 and 2009-xxxxx, filed on Nov. 26, 2008 and Oct. xx, 2009, respectively, the entire contents of which are herein incorporated by reference.

What is claimed is:

1. An electrophotographic photoreceptor, comprising a charge generation layer over an electroconductive substrate, and a charge transport layer on the charge generation layer, wherein the charge generation layer comprises titanylphthalocyanine and a binder resin which is a crosslinked material of a resin comprising a polyvinylbutyral site having the following formula (1) and an isocyanate compound having the following formula (4):

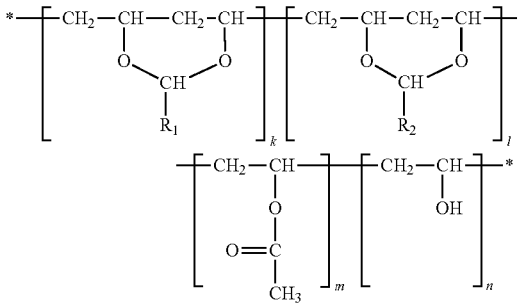

wherein R1 and R2 independently represent an alkyl group having 1 to 3 carbon atoms; k, l, m and n represent composition ratios and k+1 is from 0.60 to 0.80, wherein k or 1 may be 0, m is from 0.02 to 0.03, and n is from 0.20 to 0.40;

(4)

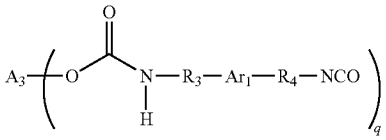

wherein $A_3$ represents a substituted or an unsubstituted non-aromatic hydrocarbon group or an aryl group; $Ar_1$ represents a substituted or an unsubstituted aromatic ring; $R_3$ and $R_4$ independently represent a divalent organic group having 1 to 3 carbon atoms when $A_3$ is a non-aromatic hydrocarbon group and a single bond when $A_3$ is an aryl group; and q represents an integer of from 2 to 4.

2. The electrophotographic photoreceptor of claim 1, wherein n in the formula (1) is from 0.30 to 0.40.

3. The electrophotographic photoreceptor of claim 1, further comprising:

an undercoat layer positioned between the electroconductive substrate and the charge generation layer.

4. An image forming apparatus, comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a developer comprising a toner to form a toner image on the electrophotographic photoreceptor; and a transferer configured to transfer the toner image onto a transfer material.

5. The image forming apparatus of claim 4, wherein the electrophotographic photoreceptor and at least one of the charger. the irradiator, the transferer and a cleaner are unified as a process cartridge.

6. A process cartridge for image forming apparatus, comprising:

electrophotographic photoreceptor according to claim 1; and at least one of a charger configured to charge the electrophotographic photoreceptor;

an irradiator configured to irradiate the electrophotographic photoreceptor to form an electrostatic latent image thereon;

an image developer configured to develop the electrostatic latent image with a developer comprising a toner to form a toner image on the electrophotographic photoreceptor; and a cleaner configured to clean the toner remaining on the electrophotographic photoreceptor after the toner image is transferred therefrom.

* * * * *